US008820656B2

(12) United States Patent
Tryon et al.

(10) Patent No.: US 8,820,656 B2
(45) **Date of Patent: *Sep. 2, 2014**

(54) DISPENSER FOR AEROSOL SYSTEMS

(71) Applicant: Homax Products, Inc., Bellingham, WA (US)

(72) Inventors: James A. Tryon, Seattle, WA (US); Lester R. Greer, Jr., Seattle, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/742,232

(22) Filed: Jan. 15, 2013

(65) Prior Publication Data

US 2013/0126632 A1 May 23, 2013

Related U.S. Application Data

(63) Continuation of application No. 13/271,045, filed on Oct. 11, 2011, now Pat. No. 8,353,465, which is a (Continued)

(51) Int. Cl.

| | |
|---|---|
| ***B05B 17/04*** | (2006.01) |
| ***B65D 83/14*** | (2006.01) |
| ***B65D 83/22*** | (2006.01) |
| *B65D 83/20* | (2006.01) |
| *B05B 1/32* | (2006.01) |

(52) U.S. Cl.

CPC ..... *B65D 83/22* (2013.01); *B65D 83/753* (2013.01); *B65D 83/206* (2013.01); *Y10S 239/12* (2013.01); *B65D 83/226* (2013.01); *B65D 83/7538* (2013.01); *B65D 83/205* (2013.01); *B05B 1/32* (2013.01)

USPC ..... 239/11; 239/337; 239/437; 239/438; 239/546; 239/602; 239/DIG. 12; 222/402.1

(58) Field of Classification Search

USPC ..... 239/1, 11, 337, 436, 437, 438, 546, 239/602, DIG. 12; 222/402.1

See application file for complete search history.

(56) References Cited

U.S. PATENT DOCUMENTS 208,330 A 9/1878 Palmer (Continued)

FOREIGN PATENT DOCUMENTS

| | | |
|---|---|---|
| CA | 770467 | 10/1967 |
| CA | 976125 | 10/1975 |

(Continued)

OTHER PUBLICATIONS

ASTM Designation: G61-86, Standard Test Method for Conducting Cyclic Potentiodynamic Polarization Measurements for Localized Corrosion Susceptibility of Iron-Nickel-, or Cobalt-Based Alloys, (Reapproved 1993), pp. 238-242, Philadelphia, PA.

(Continued)

*Primary Examiner* — Steven J Ganey

(74) *Attorney, Agent, or Firm* — Michael R. Schacht; Schacht Law Office, Inc.

(57) ABSTRACT

An aerosol system for dispensing liquid material, comprising a container assembly and an actuator assembly comprising an outlet member defining an outlet opening, a collar member, an actuator member, and a selector member. The actuator member supports the collar member and the outlet member such that movement of the collar member relative to the actuator member causes the collar member to deform the outlet member. Movement of the selector member relative to the collar member moves the collar member relative to the actuator member. Deformation of the outlet member alters a cross-sectional area of the outlet opening. When the actuator assembly is in a first position, the liquid material is prevented from flowing out of the container. When the actuator assembly is in a second position, the liquid material is allowed to flow out of the container assembly through the outlet opening.

20 Claims, 14 Drawing Sheets

Related U.S. Application Data continuation of application No. 12/401,495, filed on Mar. 10, 2009, now Pat. No. 8,033,484, which is a continuation of application No. 11/502,250, filed on Aug. 9, 2006, now Pat. No. 7,500,621, which is a continuation-in-part of application No. 10/411,779, filed on Apr. 10, 2003, now abandoned.

(56) References Cited

U.S. PATENT DOCUMENTS

| | | | |
|---|---|---|---|
| 351,968 | A | 11/1886 | Derrick |
| D25,916 | S | 8/1896 | Woods |
| 568,876 | A | 10/1896 | Regan |
| 579,418 | A | 3/1897 | Bookwalter |
| 582,397 | A | 5/1897 | Shone |
| 604,151 | A | 5/1898 | Horn |
| 625,594 | A | 5/1899 | Oldham |
| 658,586 | A | 9/1900 | Reiling |
| 930,095 | A | 8/1909 | Seagrave |
| 931,757 | A | 8/1909 | Harmer |
| 941,671 | A | 11/1909 | Campbell |
| 1,093,907 | A | 4/1914 | Birnbaum |
| 1,154,974 | A | 9/1915 | Custer |
| 1,162,170 | A | 11/1915 | Johnson |
| 1,294,190 | A | 2/1919 | Sturcke |
| 1,332,544 | A | 3/1920 | Davis |
| 1,486,156 | A | 3/1924 | Needham |
| 1,590,430 | A | 6/1926 | Erby |
| 1,609,465 | A | 12/1926 | Day |
| 1,643,969 | A | 10/1927 | Tittemore et al. |
| 1,650,686 | A | 11/1927 | Binks |
| 1,656,132 | A | 1/1928 | Arrasmith et al. |
| 1,809,073 | A | 10/1928 | Schylander |
| 1,755,329 | A | 4/1930 | McCormack |
| 1,770,011 | A | 7/1930 | Poston |
| 1,863,924 | A | 6/1932 | Dunn |
| 1,988,017 | A | 1/1935 | Norwick |
| 2,127,188 | A | 8/1938 | Schellin et al. |
| 2,149,930 | A | 3/1939 | Plastaras |
| 2,198,271 | A | 4/1940 | McCallum |
| D134,562 | S | 7/1942 | Murphy |
| 2,305,269 | A | 12/1942 | Moreland |
| 2,307,014 | A | 1/1943 | Becker et al. |
| 2,320,964 | A | 6/1943 | Yates |
| 2,353,318 | A | 7/1944 | Scheller |
| 2,388,093 | A | 10/1945 | Smith |
| 2,530,808 | A | 11/1950 | Cerasi |
| 2,565,954 | A | 8/1951 | Dey |
| 2,612,293 | A | 9/1952 | Michel |
| 2,686,652 | A | 8/1954 | Carlson et al. |
| 2,704,690 | A | 3/1955 | Echenauer |
| 2,723,200 | A | 11/1955 | Pyenson |
| 2,763,406 | A | 9/1956 | Countryman |
| 2,764,454 | A | 9/1956 | Edelstein |
| 2,923,481 | A | 2/1957 | Pinke |
| 2,785,926 | A | 3/1957 | Lataste |
| 2,790,680 | A | 4/1957 | Rosholt |
| 2,801,880 | A | 8/1957 | Rienecker |
| 2,831,618 | A | 4/1958 | Soffer et al. |
| 2,839,225 | A | 6/1958 | Soffer et al. |
| 2,887,274 | A | 5/1959 | Swenson |
| 2,908,446 | A | 10/1959 | Strouse |
| 2,932,434 | A | 4/1960 | Abplanalp |
| 2,965,270 | A | 12/1960 | Soffer et al. |
| 2,968,441 | A | 1/1961 | Holcomb |
| 2,976,897 | A | 3/1961 | Beckworth |
| 2,997,243 | A | 8/1961 | Kolb |
| 2,999,646 | A | 9/1961 | Wagner |
| 3,027,096 | A | 3/1962 | Giordano |
| 3,083,872 | A | 4/1963 | Meshberg |
| 3,107,059 | A | 10/1963 | Frechette |
| 3,116,879 | A | 1/1964 | Wagner |
| 3,157,360 | A | 11/1964 | Heard |
| 3,167,525 | A | 1/1965 | Thomas |
| 3,191,809 | A | 6/1965 | Schultz et al. |
| 3,196,819 | A | 7/1965 | Lechner et al. |
| 3,198,394 | A | 8/1965 | Lefer |
| 3,207,444 | A | 9/1965 | Kelley et al. |
| 3,216,628 | A | 11/1965 | Fergusson |
| 3,236,459 | A | 2/1966 | McRitchie |
| 3,246,850 | A | 4/1966 | Bourke |
| 3,258,208 | A | 6/1966 | Greenebaum, II |
| 3,284,007 | A | 11/1966 | Clapp |
| 3,307,788 | A | 3/1967 | Ingram |
| 3,314,571 | A | 4/1967 | Greenebaum, II |
| 3,317,140 | A | 5/1967 | Smith |
| 3,342,382 | A | 9/1967 | Huling |
| 3,346,195 | A | 10/1967 | Groth |
| 3,373,908 | A | 3/1968 | Crowell |
| 3,377,028 | A | 4/1968 | Bruggeman |
| 3,390,121 | A | 6/1968 | Burford |
| 3,414,171 | A | 12/1968 | Grisham et al. |
| 3,415,425 | A | 12/1968 | Knight et al. |
| 3,425,600 | A | 2/1969 | Abplanalp |
| 3,428,224 | A | 2/1969 | Eberhardt et al. |
| 3,433,391 | A | 3/1969 | Krizka et al. |
| 3,445,068 | A | 5/1969 | Wagner |
| 3,450,314 | A | 6/1969 | Gross |
| 3,467,283 | A | 9/1969 | Kinnavy |
| 3,472,457 | A | 10/1969 | McAvoy |
| 3,482,738 | A | 12/1969 | Bartels |
| 3,491,951 | A | 1/1970 | Knibb |
| 3,498,541 | A | 3/1970 | Taylor, Jr. et al. |
| 3,513,886 | A | 5/1970 | Easter et al. |
| 3,514,042 | A | 5/1970 | Freed |
| 3,544,258 | A | 12/1970 | Presant et al. |
| 3,548,564 | A | 12/1970 | Bruce et al. |
| 3,550,861 | A | 12/1970 | Teson |
| 3,575,319 | A | 4/1971 | Safianoff |
| 3,592,359 | A | 7/1971 | Marraffino |
| 3,596,835 | A | 8/1971 | Smith |
| 3,608,822 | A | 9/1971 | Berthoud |
| 3,613,954 | A | 10/1971 | Bayne |
| 3,647,143 | A | 3/1972 | Gauthier et al. |
| 3,648,932 | A | 3/1972 | Ewald et al. |
| 3,653,558 | A | 4/1972 | Shay |
| 3,680,789 | A | 8/1972 | Wagner |
| 3,698,645 | A | 10/1972 | Coffey |
| 3,700,136 | A | 10/1972 | Ruekberg |
| 3,703,994 | A | 11/1972 | Nigro |
| 3,704,811 | A | 12/1972 | Harden, Jr. |
| 3,704,831 | A | 12/1972 | Clark |
| 3,705,669 | A | 12/1972 | Cox et al. |
| 3,711,030 | A | 1/1973 | Jones |
| 3,764,067 | A | 10/1973 | Coffey et al. |
| 3,770,166 | A | 11/1973 | Marand |
| 3,773,706 | A | 11/1973 | Dunn, Jr. |
| 3,776,470 | A | 12/1973 | Tsuchiya |
| 3,776,702 | A | 12/1973 | Chant |
| 3,777,981 | A | 12/1973 | Probst et al. |
| 3,788,521 | A | 1/1974 | Laauwe |
| 3,788,526 | A | 1/1974 | Thornton et al. |
| 3,795,366 | A | 3/1974 | McGhie et al. |
| 3,799,398 | A | 3/1974 | Morane et al. |
| 3,806,005 | A | 4/1974 | Prussin et al. |
| 3,811,369 | A | 5/1974 | Ruegg |
| 3,813,011 | A | 5/1974 | Harrison et al. |
| 3,814,326 | A | 6/1974 | Bartlett |
| 3,819,119 | A | 6/1974 | Coffey et al. |
| 3,828,977 | A | 8/1974 | Borchert |
| 3,848,778 | A | 11/1974 | Meshberg |
| 3,848,808 | A | 11/1974 | Fetty et al. |
| 3,862,705 | A | 1/1975 | Beres et al. |
| 3,871,553 | A | 3/1975 | Steinberg |
| 3,876,154 | A | 4/1975 | Griebel |
| 3,891,128 | A | 6/1975 | Smrt |
| 3,899,134 | A | 8/1975 | Wagner |
| 3,912,132 | A | 10/1975 | Stevens |
| 3,913,803 | A | 10/1975 | Laauwe |
| 3,913,804 | A | 10/1975 | Laauwe |
| 3,913,842 | A | 10/1975 | Singer |

(56) References Cited

U.S. PATENT DOCUMENTS

| | | | |
|---|---|---|---|
| D237,796 | S | 11/1975 | Wagner |
| 3,932,973 | A | 1/1976 | Moore |
| 3,936,002 | A | 2/1976 | Geberth, Jr. |
| 3,938,708 | A | 2/1976 | Burger |
| 3,945,571 | A | 3/1976 | Rash |
| 3,975,554 | A | 8/1976 | Kummins et al. |
| 3,982,698 | A | 9/1976 | Anderson |
| 3,987,811 | A | 10/1976 | Finger |
| 3,989,165 | A | 11/1976 | Shaw et al. |
| 3,991,916 | A | 11/1976 | Del Bon |
| 3,992,003 | A | 11/1976 | Visceglia et al. |
| 4,010,134 | A | 3/1977 | Braunisch et al. |
| 4,032,064 | A | 6/1977 | Giggard |
| 4,036,438 | A | 7/1977 | Soderlind et al. |
| 4,036,673 | A | 7/1977 | Murphy et al. |
| 4,045,860 | A | 9/1977 | Winckler |
| 4,058,287 | A | 11/1977 | Fromfield |
| 4,078,578 | A | 3/1978 | Buchholz |
| 4,089,443 | A | 5/1978 | Zrinyi |
| 4,096,974 | A | 6/1978 | Haber et al. |
| 4,117,951 | A | 10/1978 | Winckler |
| 4,123,005 | A | 10/1978 | Blunk |
| 4,129,448 | A | 12/1978 | Greenfield et al. |
| 4,147,284 | A | 4/1979 | Mizzi |
| 4,148,416 | A | 4/1979 | Gunn-Smith |
| 4,154,378 | A | 5/1979 | Paoletti et al. |
| 4,159,079 | A | 6/1979 | Phillips, Jr. |
| 4,164,492 | A | 8/1979 | Cooper |
| RE30,093 | E | 9/1979 | Burger |
| 4,171,757 | A | 10/1979 | Diamond |
| 4,185,758 | A | 1/1980 | Giggard |
| 4,187,959 | A | 2/1980 | Pelton |
| 4,187,985 | A | 2/1980 | Goth |
| 4,195,780 | A | 4/1980 | Inglis |
| 4,198,365 | A | 4/1980 | Pelton |
| 4,202,470 | A | 5/1980 | Fujii |
| 4,204,645 | A | 5/1980 | Hopp |
| 4,232,828 | A | 11/1980 | Shelly, Jr. |
| 4,238,264 | A | 12/1980 | Pelton |
| 4,258,141 | A | 3/1981 | Jarre et al. |
| 4,275,172 | A | 6/1981 | Barth et al. |
| 4,293,353 | A | 10/1981 | Pelton et al. |
| 4,308,973 | A | 1/1982 | Irland |
| 4,310,108 | A | 1/1982 | Motoyama et al. |
| 4,322,020 | A | 3/1982 | Stone |
| 4,346,743 | A | 8/1982 | Miller |
| 4,354,638 | A | 10/1982 | Weinstein |
| 4,358,388 | A | 11/1982 | Daniel et al. |
| 4,364,521 | A | 12/1982 | Stankowitz |
| 4,370,930 | A | 2/1983 | Strasser et al. |
| 4,372,475 | A | 2/1983 | Goforth et al. |
| 4,401,271 | A | 8/1983 | Hansen |
| 4,401,272 | A | 8/1983 | Merton et al. |
| 4,411,387 | A | 10/1983 | Stern et al. |
| 4,417,674 | A | 11/1983 | Giuffredi |
| 4,434,939 | A | 3/1984 | Stankowitz |
| 4,438,221 | A | 3/1984 | Fracalossi et al. |
| 4,438,884 | A | 3/1984 | O'Brien et al. |
| 4,442,959 | A | 4/1984 | Del Bon et al. |
| 4,460,719 | A | 7/1984 | Danville |
| 4,482,662 | A | 11/1984 | Rapaport et al. |
| 4,496,081 | A | 1/1985 | Farrey |
| 4,546,905 | A | 10/1985 | Nandagiri et al. |
| 4,595,127 | A | 6/1986 | Stoody |
| 4,609,608 | A | 9/1986 | Solc |
| 4,620,669 | A | 11/1986 | Polk |
| 4,641,765 | A | 2/1987 | Diamond |
| 4,683,246 | A | 7/1987 | Davis et al. |
| 4,685,622 | A | 8/1987 | Shimohira et al. |
| 4,702,400 | A | 10/1987 | Corbett |
| 4,706,888 | A | 11/1987 | Dobbs |
| 4,728,007 | A | 3/1988 | Samuelson et al. |
| 4,744,495 | A | 5/1988 | Warby |
| 4,744,516 | A | 5/1988 | Peterson et al. |
| 4,761,312 | A | 8/1988 | Koshi et al. |
| 4,792,062 | A | 12/1988 | Goncalves |
| 4,793,162 | A | 12/1988 | Emmons |
| 4,804,144 | A | 2/1989 | Denman |
| 4,815,414 | A | 3/1989 | Duffy et al. |
| 4,819,838 | A | 4/1989 | Hart, Jr. |
| 4,830,224 | A | 5/1989 | Brison |
| 4,839,393 | A | 6/1989 | Buchanan et al. |
| 4,850,387 | A | 7/1989 | Bassill |
| 4,854,482 | A | 8/1989 | Bergner |
| 4,863,104 | A | 9/1989 | Masterson |
| 4,870,805 | A | 10/1989 | Morane |
| 4,878,599 | A | 11/1989 | Greenway |
| 4,887,651 | A | 12/1989 | Santiago |
| 4,893,730 | A | 1/1990 | Bolduc |
| 4,896,832 | A | 1/1990 | Howlett |
| D307,649 | S | 5/1990 | Henry |
| 4,940,171 | A | 7/1990 | Gilroy |
| 4,948,054 | A | 8/1990 | Mills |
| 4,949,871 | A | 8/1990 | Flanner |
| 4,951,876 | A | 8/1990 | Mills |
| 4,953,759 | A | 9/1990 | Schmidt |
| 4,954,544 | A | 9/1990 | Chandaria |
| 4,955,545 | A | 9/1990 | Stern et al. |
| 4,961,537 | A | 10/1990 | Stern |
| 4,969,577 | A | 11/1990 | Werding |
| 4,969,579 | A | 11/1990 | Behar |
| 4,988,017 | A | 1/1991 | Schrader et al. |
| 4,989,787 | A | 2/1991 | Nikkel et al. |
| 4,991,750 | A | 2/1991 | Moral |
| 5,007,556 | A | 4/1991 | Lover |
| 5,009,390 | A | 4/1991 | McAuliffe, Jr. et al. |
| 5,037,011 | A | 8/1991 | Woods |
| 5,038,964 | A | 8/1991 | Bouix |
| 5,039,017 | A | 8/1991 | Howe |
| 5,052,585 | A | 10/1991 | Bolduc |
| 5,059,187 | A | 10/1991 | Sperry et al. |
| 5,065,900 | A | 11/1991 | Scheindel |
| 5,069,390 | A | 12/1991 | Stern et al. |
| 5,083,685 | A | 1/1992 | Amemiya et al. |
| 5,100,055 | A | 3/1992 | Rokitenetz et al. |
| 5,115,944 | A | 5/1992 | Nikolich |
| 5,126,086 | A | 6/1992 | Stoffel |
| 5,150,880 | A | 9/1992 | Austin, Jr. et al. |
| 5,169,037 | A | 12/1992 | Davies et al. |
| 5,182,316 | A | 1/1993 | DeVoe et al. |
| 5,188,263 | A | 2/1993 | Woods |
| 5,188,295 | A | 2/1993 | Stern et al. |
| 5,211,317 | A | 5/1993 | Diamond et al. |
| 5,219,609 | A | 6/1993 | Owens |
| 5,232,161 | A | 8/1993 | Clemmons |
| 5,255,846 | A | 10/1993 | Ortega |
| 5,277,336 | A | 1/1994 | Youel |
| 5,288,024 | A | 2/1994 | Vitale |
| 5,297,704 | A | 3/1994 | Stollmeyer |
| 5,307,964 | A | 5/1994 | Toth |
| 5,310,095 | A | 5/1994 | Stern et al. |
| 5,312,888 | A | 5/1994 | Nafziger et al. |
| 5,314,097 | A | 5/1994 | Smrt et al. |
| 5,323,963 | A | 6/1994 | Ballu |
| 5,341,970 | A | 8/1994 | Woods |
| 5,360,127 | A | 11/1994 | Barriac et al. |
| 5,368,207 | A | 11/1994 | Cruysberghs |
| 5,374,434 | A | 12/1994 | Clapp et al. |
| 5,405,051 | A | 4/1995 | Miskell |
| 5,409,148 | A | 4/1995 | Stern et al. |
| 5,415,351 | A | 5/1995 | Otto et al. |
| 5,417,357 | A | 5/1995 | Yquel |
| D358,989 | S | 6/1995 | Woods |
| 5,421,519 | A | 6/1995 | Woods |
| 5,425,824 | A | 6/1995 | Marwick |
| 5,443,211 | A | 8/1995 | Young et al. |
| 5,450,983 | A | 9/1995 | Stern et al. |
| 5,467,902 | A | 11/1995 | Yquel |
| 5,476,879 | A | 12/1995 | Woods et al. |
| 5,489,048 | A | 2/1996 | Stern et al. |
| 5,498,282 | A | 3/1996 | Miller et al. |

(56) References Cited

U.S. PATENT DOCUMENTS

| | | | |
|---|---|---|---|
| 5,501,375 | A | 3/1996 | Nilson |
| 5,505,344 | A | 4/1996 | Woods |
| 5,523,798 | A | 6/1996 | Hagino et al. |
| 5,524,798 | A | 6/1996 | Stern et al. |
| 5,544,783 | A | 8/1996 | Conigliaro |
| 5,548,010 | A | 8/1996 | Franer |
| 5,549,228 | A | 8/1996 | Brown |
| 5,558,247 | A | 9/1996 | Caso |
| 5,562,235 | A | 10/1996 | Cruysberghs |
| 5,570,813 | A | 11/1996 | Clark, II |
| 5,573,137 | A | 11/1996 | Pauls |
| 5,583,178 | A | 12/1996 | Oxman et al. |
| 5,597,095 | A | 1/1997 | Ferrara, Jr. |
| 5,615,804 | A | 4/1997 | Brown |
| 5,639,026 | A | 6/1997 | Woods |
| 5,641,095 | A | 6/1997 | de Laforcade |
| 5,645,198 | A | 7/1997 | Stern et al. |
| 5,655,691 | A | 8/1997 | Stern et al. |
| 5,715,975 | A | 2/1998 | Stern et al. |
| 5,727,736 | A | 3/1998 | Tryon |
| 5,752,631 | A | 5/1998 | Yabuno et al. |
| 5,775,432 | A | 7/1998 | Burns et al. |
| 5,792,465 | A | 8/1998 | Hagarty |
| 5,799,879 | A | 9/1998 | Ottl et al. |
| 5,865,351 | A | 2/1999 | De Laforcade |
| 5,887,756 | A | 3/1999 | Brown |
| 5,894,964 | A | 4/1999 | Barnes et al. |
| 5,915,598 | A | 6/1999 | Yazawa et al. |
| 5,921,446 | A | 7/1999 | Stern |
| 5,934,518 | A | 8/1999 | Stern et al. |
| 5,941,462 | A | 8/1999 | Sandor |
| 5,957,333 | A | 9/1999 | Losenno et al. |
| 5,975,356 | A | 11/1999 | Yquel et al. |
| 5,979,797 | A | 11/1999 | Castellano |
| 5,988,575 | A | 11/1999 | Lesko |
| 6,000,583 | A | 12/1999 | Stern et al. |
| 6,027,042 | A | 2/2000 | Smith |
| 6,032,830 | A | 3/2000 | Brown |
| 6,039,306 | A | 3/2000 | Pericard et al. |
| 6,062,494 | A | 5/2000 | Mills |
| 6,070,770 | A | 6/2000 | Tada et al. |
| 6,092,698 | A | 7/2000 | Bayer |
| 6,095,377 | A | 8/2000 | Sweeton et al. |
| 6,095,435 | A | 8/2000 | Greer, Jr. et al. |
| 6,112,945 | A | 9/2000 | Woods |
| 6,113,070 | A | 9/2000 | Holzboog |
| 6,116,473 | A | 9/2000 | Stern et al. |
| 6,126,090 | A | 10/2000 | Wadsworth et al. |
| 6,129,247 | A | 10/2000 | Thomas et al. |
| 6,131,777 | A | 10/2000 | Warby |
| 6,131,820 | A | 10/2000 | Dodd |
| 6,152,335 | A | 11/2000 | Stern et al. |
| 6,161,735 | A | 12/2000 | Uchiyama et al. |
| 6,168,093 | B1 | 1/2001 | Greer, Jr. et al. |
| 6,170,717 | B1 | 1/2001 | Di Giovanni et al. |
| D438,111 | S | 2/2001 | Woods |
| D438,786 | S | 3/2001 | Ghali |
| 6,225,393 | B1 | 5/2001 | Woods |
| 6,227,411 | B1 | 5/2001 | Good |
| 6,254,015 | B1 | 7/2001 | Abplanalp |
| 6,257,503 | B1 | 7/2001 | Baudin |
| 6,261,631 | B1 | 7/2001 | Lomasney et al. |
| 6,265,459 | B1 | 7/2001 | Mahoney et al. |
| 6,276,570 | B1 | 8/2001 | Stern et al. |
| 6,283,171 | B1 | 9/2001 | Blake |
| 6,284,077 | B1 | 9/2001 | Lucas et al. |
| 6,290,104 | B1 | 9/2001 | Bougamont et al. |
| 6,291,536 | B1 | 9/2001 | Taylor |
| 6,296,155 | B1 | 10/2001 | Smith |
| 6,296,156 | B1 | 10/2001 | Lasserre et al. |
| 6,299,679 | B1 | 10/2001 | Montoya |
| 6,299,686 | B1 | 10/2001 | Mills |
| 6,315,152 | B1 | 11/2001 | Kalisz |
| 6,325,256 | B1 | 12/2001 | Liljeqvist et al. |
| 6,328,185 | B1 | 12/2001 | Stern et al. |
| 6,328,197 | B1 | 12/2001 | Gapihan |
| 6,333,365 | B1 | 12/2001 | Lucas et al. |
| 6,352,184 | B1 | 3/2002 | Stern et al. |
| 6,362,302 | B1 | 3/2002 | Boddie |
| 6,375,036 | B1 | 4/2002 | Woods |
| 6,382,474 | B1 | 5/2002 | Woods et al. |
| 6,386,402 | B1 | 5/2002 | Woods |
| 6,394,321 | B1 | 5/2002 | Bayer |
| 6,394,364 | B1 | 5/2002 | Abplanalp |
| 6,395,794 | B2 | 5/2002 | Lucas et al. |
| 6,398,082 | B2 | 6/2002 | Clark et al. |
| 6,399,687 | B2 | 6/2002 | Woods |
| 6,414,044 | B2 | 7/2002 | Taylor |
| 6,415,964 | B2 | 7/2002 | Woods |
| 6,439,430 | B1 | 8/2002 | Gilroy, Sr. et al. |
| 6,446,842 | B2 | 9/2002 | Stern et al. |
| 6,474,513 | B2 | 11/2002 | Burt |
| 6,478,198 | B2 | 11/2002 | Haroian |
| 6,478,561 | B2 | 11/2002 | Braun et al. |
| 6,482,392 | B1 | 11/2002 | Zhou et al. |
| 6,510,969 | B2 | 1/2003 | Di Giovanni et al. |
| 6,520,377 | B2 | 2/2003 | Yquel |
| 6,531,528 | B1 | 3/2003 | Kurp |
| 6,536,633 | B2 | 3/2003 | Stern et al. |
| 6,883,688 | B1 | 4/2005 | Stern et al. |
| 7,278,590 | B1 | 10/2007 | Greer, Jr. et al. |
| 7,303,152 | B2 * | 12/2007 | Woods ..... 239/337 |
| 7,303,153 | B2 | 12/2007 | Woods |
| 8,033,484 | B2 | 10/2011 | Tryon et al. |
| 2001/0002676 | A1 | 6/2001 | Woods |
| 2002/0003147 | A1 | 1/2002 | Corba |
| 2002/0100769 | A1 | 8/2002 | McKune |
| 2002/0119256 | A1 | 8/2002 | Woods |

FOREIGN PATENT DOCUMENTS

| | | |
|---|---|---|
| CA | 1191493 | 8/1985 |
| CA | 1210371 | 8/1986 |
| CA | 2145129 | 9/1995 |
| CA | 2090185 | 10/1998 |
| CA | 2291599 | 6/2000 |
| CA | 2381994 | 2/2001 |
| CA | 2327903 | 6/2001 |
| CA | 2065534 | 8/2003 |
| CH | 680849 | 11/1992 |
| DE | 210449 | 5/1909 |
| DE | 250831 | 9/1912 |
| DE | 634230 | 8/1936 |
| DE | 1047686 | 12/1958 |
| DE | 1926796 | 3/1970 |
| DE | 3527922 | 12/1987 |
| DE | 3808438 | 4/1989 |
| DE | 3806991 | 9/1989 |
| FR | 463476 | 2/1914 |
| FR | 84727 | 4/1964 |
| FR | 1586067 | 2/1970 |
| FR | 2336186 | 7/1977 |
| FR | 2659847 | 9/1991 |
| GB | 470488 | 11/1935 |
| GB | 491396 | 9/1938 |
| GB | 494134 | 10/1938 |
| GB | 508734 | 7/1939 |
| GB | 534349 | 3/1941 |
| GB | 675664 | 7/1952 |
| GB | 726455 | 3/1955 |
| GB | 867713 | 5/1961 |
| GB | 977860 | 12/1964 |
| GB | 1144385 | 5/1969 |
| GB | 1536312 | 12/1978 |
| JP | 461392 | 1/1971 |

(56) References Cited

FOREIGN PATENT DOCUMENTS

| | | |
|---|---|---|
| JP | 8332414 | 6/1995 |
| NL | 8000344 | 8/1981 |
| WO | 9418094 | 8/1994 |

OTHER PUBLICATIONS

Homax Products, Inc., "Easy Touch Spray Texture Brochure", Mar. 1992, 1 page.

Newman-Green, Inc., "Aerosol Valves, Sprayheads & Accessories Catalog", Apr. 1, 1992, pp. 14, 20, and 22.

W. S. Tait, An Introduction to Electrochemical Corrosion Testing for Practicing Engineers and Scientists, 1994, Chapter 6, pp. 63-77, Pair O Docs Publications, Racine, WI.

Saint-Gobain Calmar; "Mixor HP Trigger Sprayer Brochure", Dec. 2001; 2 pages.

* cited by examiner

DISPENSER FOR AEROSOL SYSTEMS

RELATED APPLICATIONS

This application, U.S. patent application Ser. No. 13/742,232 filed Jan. 15, 2013, is a continuation of U.S. patent application Ser. No. 13/271,045 filed Oct. 11, 2011.

U.S. patent application Ser. No. 13/271,045 is a continuation of U.S. patent application Ser. No. 12/401,495 filed Mar. 10, 2009, now U.S. Pat. No. 8,033,484, which issued on Oct. 11, 2011.

U.S. patent application Ser. No. 12/401,495 is a continuation of U.S. application Ser. No. 11/502,250, filed Aug. 9, 2006, now U.S. Pat. No. 7,500,621, which issued on Mar. 10, 2009.

U.S. application Ser. No. 11/502,250 is a continuation-in-part of U.S. patent application Ser. No. 10/411,779, filed on Apr. 10, 2003, now abandoned.

The contents of all related applications are incorporated herein by reference.

TECHNICAL FIELD

The present invention relates to aerosol systems having variable outlet openings.

BACKGROUND

Aerosol systems comprise an aerosol assembly and a liquid product to be dispensed. The aerosol assembly conventionally comprises a container, a valve assembly, an actuator assembly, and a cap. The liquid product is disposed within the container along with a propellant material that pressurizes the product. The valve assembly is normally in a closed configuration but may be placed in an open configuration to allow pressurized product to exit the container. The actuator assembly engages the valve assembly such that pressing the actuator assembly places the valve assembly in the open configuration to allow the product to be dispensed through a nozzle formed by the actuator assembly. The cap engages the container to protect the actuator assembly when the aerosol system is not in use.

For some materials being dispensed, the actuator assembly defines an outlet opening having an effective cross-sectional area that may be varied. Examples of actuators that define outlet openings the effective cross-sectional areas of which may be varied are described in the Applicant's U.S. Pat. No. 6,328,185, the specification of which is incorporated herein by reference. In the systems described U.S. Pat. No. 6,328,185, the outlet opening is changed to obtain different spray patterns and the like; this structure is of particular significance when the material to be dispensed is texture material. Texture material is deposited on a surface in a texture pattern for aesthetic purposes. The invention will be described herein in the context of an actuator assembly having a variable outlet opening, but certain aspects of the present invention may be applied to other types of actuators as will become apparent from the following discussion.

The cap employed by many aerosol systems prevents accidental discharge of product in many situations. However, it is possible that the cap may deformed by a load thereon sufficiently that product will be dispensed accidentally. In addition, the cap itself will not prevent malicious tampering with the product. A person wishing to tamper with the aerosol system can simply remove the cap and depress the actuator button.

Tampering is an even greater concern with a certain class of aerosol systems. In particular, certain aerosol systems employ a compressed inert gas such as air or nitrogen as the propellant material. The inert gas is typically lighter than the product being dispensed and will collect at the upper end of the container, so the aerosol assembly is designed with a dip tube that extends to the bottom of the container. When container is upright and the valve assembly is in the open configuration, the pressurized inert gas forces the product out of the container through the dip tube. However, if the container is inverted when the valve assembly is in the open configuration, the inert gas is free to flow out of the container through the dip tube in a very short time and without clear evidence that tampering has taken place. Once the compressed inert gas is dispensed, the aerosol system cannot dispense any of the product within the container and is considered defective.

SUMMARY

The present invention may be embodied as an aerosol system for dispensing liquid material comprising a container assembly and an actuator assembly. The actuator assembly comprises an outlet member defining an outlet opening, a collar member, an actuator member, and a selector member. The actuator member is supported by the container assembly in first and second positions and supports the collar member and the outlet member such that movement of the collar member relative to the actuator member causes the collar member to deform the outlet member. Movement of the selector member relative to the collar member causes movement of the collar member relative to the actuator member. Deformation of the outlet member alters a cross-sectional area of the outlet opening. When the actuator assembly is in the first position, the liquid material is prevented from flowing out of the container. When the actuator assembly is in the second position, the liquid material is allowed to flow out of the container assembly through the outlet opening.

The present invention may also be embodied as a method of dispensing liquid material comprising the following steps. A container assembly, an outlet member defining an outlet opening, a collar member, an actuator member, and a selector member are provided. The collar member and the outlet member are supported on the actuator member. The selector member is supported relative to the collar member such that movement of the selector member relative to the collar member causes movement of the collar member relative to the actuator member. The actuator member is supported relative to the container assembly. The selector member is moved relative to the collar member to move the collar member relative to the actuator member to cause the collar member to deform the outlet member and thereby alter a cross-sectional area of the outlet opening. The actuator member is displaced to allow the liquid material to flow out of the container assembly through the outlet opening.

DETAILED DESCRIPTION

1. First Embodiment

Figure 1:
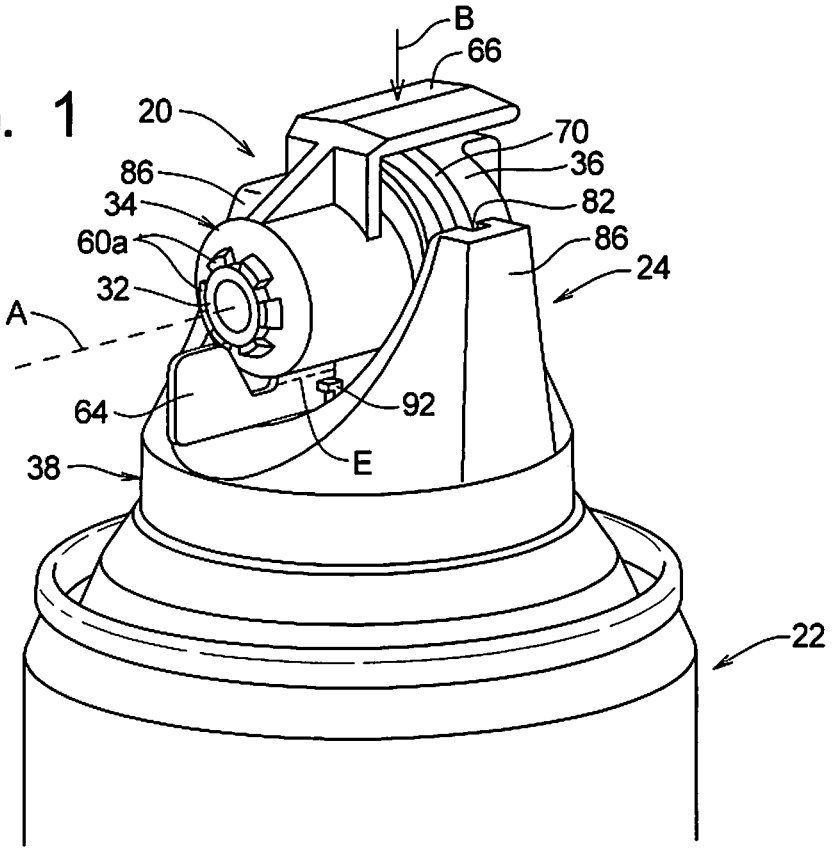
FIG. 1 is a perspective view of portion of a first embodiment of an aerosol assembly that is constructed in accordance with the principles of the present invention.
Figure 2A:
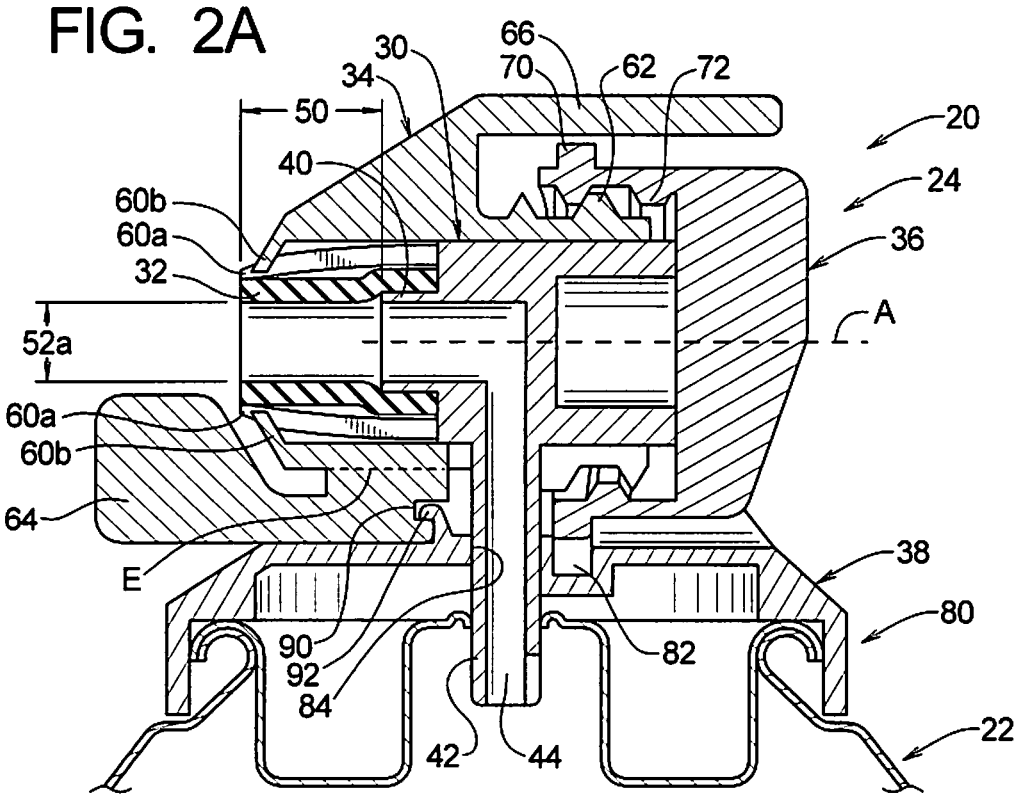
FIGS. 2A and 2B are section views of the aerosol assembly of FIG. 1.
Figure 2B:
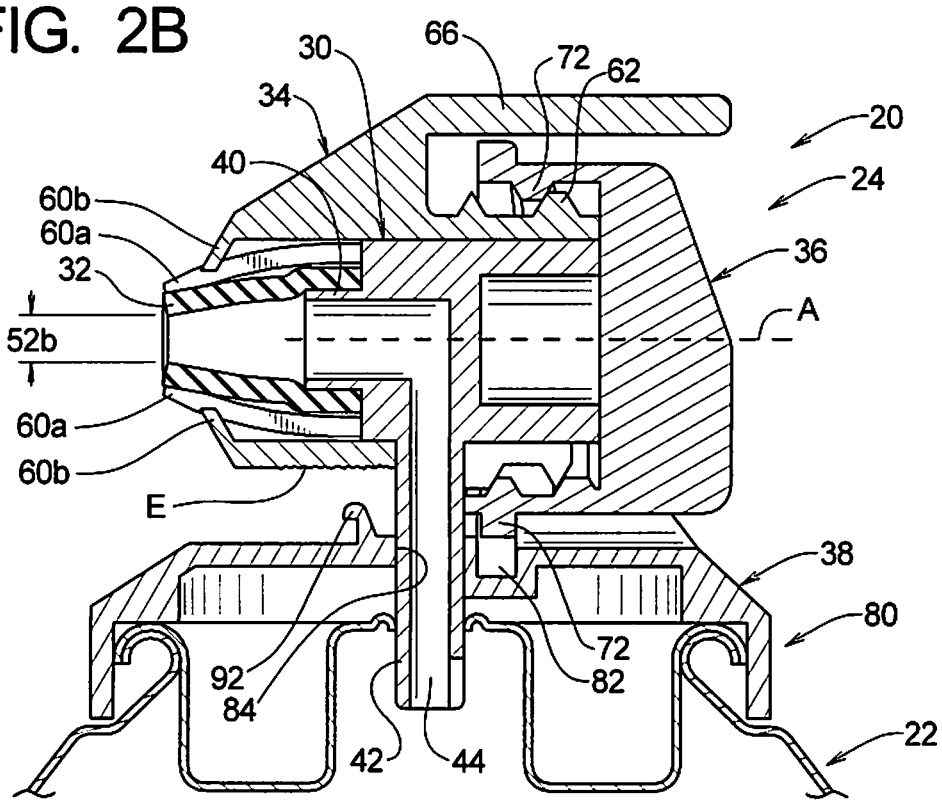
Figure 3:
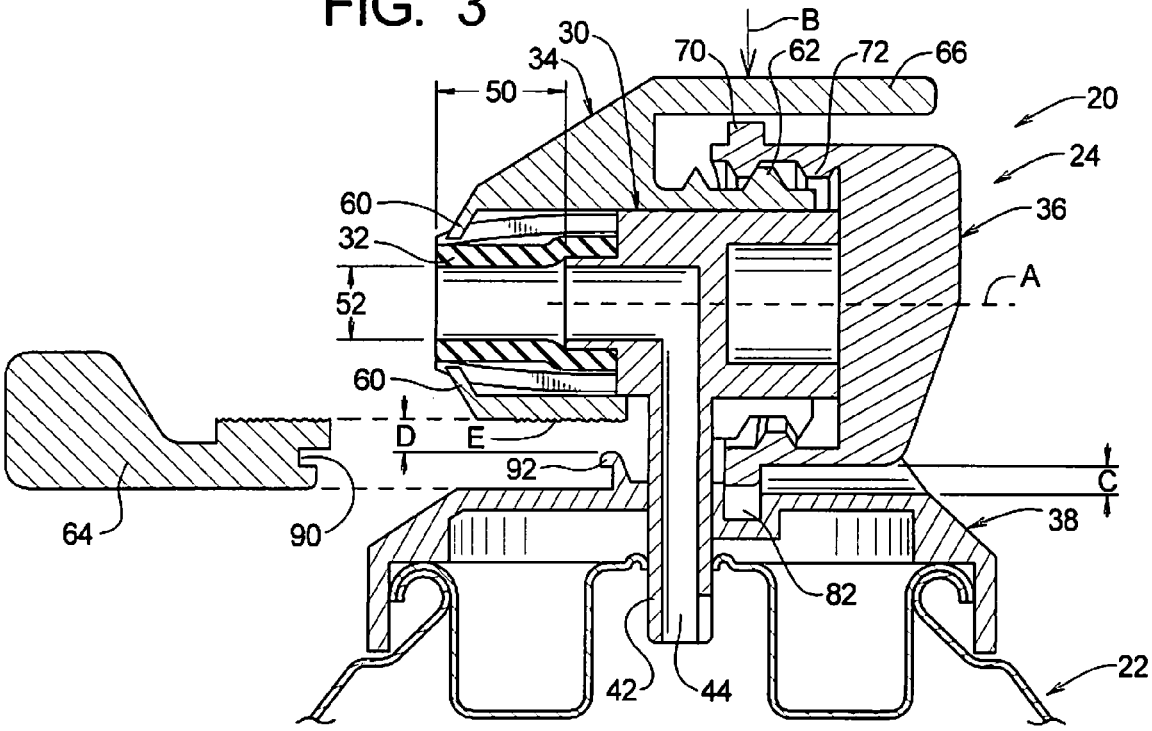
FIG. 3 is a section view similar to FIGS. 2A and 2B depicting the alteration of the aerosol assembly to allow discharge of material.

Turning now to the drawing, depicted at 20 in FIGS. 1-3 is a first embodiment of an aerosol system constructed in accordance with, and embodying, the principles of the present invention. The aerosol system 20 comprises a container assembly 22 and an actuator assembly 24. The aerosol system 20 will also typically include a valve assembly, a liquid product to be dispensed, and a propellant material. The valve assembly, liquid product, and propellant material are or may be conventional and are not shown in the drawings or described herein beyond what is necessary for a complete understanding of the present invention.

The actuator assembly 24 is mounted on the container assembly 22 for movement between first and second positions. In the first position, the valve assembly is closed and the liquid product cannot flow out of the container assembly 22. In the second position, the valve assembly is opened and the liquid product is allowed to flow out of the container assembly 22 as will be described in further detail below.

The actuator assembly 24 comprises an actuator member 30, a nozzle member 32, a slide member 34, and a collar member 36. A base member 38 is mounted on the container assembly 22 and engages the actuator assembly as will be described in further detail below.

The actuator member 30 comprises a nozzle portion 40 and a stem portion 42 and defines at least a portion of a discharge passageway 44. In the exemplary aerosol system 22, the nozzle member 32 is mounted on the nozzle portion 40 to define an outlet portion 50 of the discharge passageway 44; the portion of the discharge passageway 44 defined by the nozzle member 32 terminates in an outlet opening 52. The exemplary nozzle member 32 is a flexible, hollow cylindrical member and may be deformed to change an effective cross-sectional area of the outlet opening 52 of the discharge passageway 44.

The slide member 34 comprises a finger portion 60, a male threaded portion 62, a locking tab portion 64, and a button portion 66. The collar member 36 defines a rail portion 70 and a female threaded portion 72. The finger portion 60 of the slide member 34 extends around at least a portion of the nozzle member 32 that defines the outlet portion 50 of the discharge passageway 44. The threaded portions 62 and 72 of the slide member 34 and collar member 36 engage each other to allow displacement of the slide member 34 along an outlet axis A relative to the collar member 36 when the collar member 36 is rotated about the outlet axis A.

Under certain conditions, depressing the button portion 66 in the direction shown by arrow B in FIGS. 1 and 3 causes the slide member 34 to engage and downwardly displace the actuator member 30. Downward displacement of the actuator member 30 causes the stem portion 42 thereof to engage the valve assembly and place the valve assembly in an open configuration to allow liquid product to be dispensed from the container 22 through the discharge passageway 44.

The base member 38 comprises a mounting portion 80 and defines groove portions 82 and through opening 84. The exemplary base member 38 further comprises ear portions 86 that extend the surface area in which the groove portions 82 are formed. The mounting portion 80 engages the container 22 below the actuator assembly 24. The stem portion 42 of the actuator member 30 extends through the through opening 84 and into the container 22 to engage the valve assembly.

The rail portion 70 on the collar member 36 is annular, and the groove portions 82 in the base member 38 are arcuate. The rail portion 70 engages the groove 82 to allow the collar member 36 to rotate about the outlet axis A but prevent movement of the collar member 36 along this axis A. Because the collar member 36 cannot move along the outlet axis A, when the collar member 36 is rotated about the axis A the threaded portions 62 and 72 engage each other to cause the slide member 34 to move along this axis A relative to the base member 38, the actuator member 30, and the nozzle member 32.

The stem portion 42 of the actuator member 30 supports the actuator assembly 24 above the base member 38 such that the actuator assembly 24 moves within a defined range along a predetermined path relative to the base member 38. Referring again for a moment to FIG. 3, identified by reference character C is the distance along or range within which the actuator assembly 24 moves relative to the base member 38 and container assembly 22.

When the actuator member 30 is mounted on the container assembly 22, the locking tab portion 64 of the slide member 34 is arranged between the nozzle portion 40 of the actuator member 30 and the base member 38. The locking tab portion 64 is sized and dimensioned to prevent downward movement of the actuator member 30 relative to the base member 38. The locking tab portion 64 thus prevents the movement of the actuator assembly 24 from the first position to the second position that would cause the valve assembly of the aerosol system 20 to open.

In particular, an effective thickness D of the locking tab portion 64 (between the actuator member 30 and base member 38) is approximately equal to the range or distance C along which the actuator assembly 24 travels. Accordingly, as long as the locking tab portion 64 is attached to the slide member 34, the nozzle assembly 24 cannot move relative to the container assembly 22 and the aerosol system 20 cannot dispense texture material.

Referring now to FIG. 3, it can be seen that the locking tab portion 64 may be detached from the slide member 34. In particular, the exemplary locking tab portion 64 is scored along a parting line E such that, when the locking tap portion 64 is grasped and twisted about the parting line E, the locking tab portion 64 breaks off from the slide member 34. With the locking tab portion 64 detached as just described, nothing prevents the actuator member 30 from moving towards the base member 38.

The actuator assembly 24 thus operates in a locked state in which the locking tab portion 64 is arranged to prevent movement of the actuator member 30 towards the base member 38 and an unlocked state in which the locking tab portion 64 is detached from the slide member 34.

The exemplary locking tab portion 64 is formed as part of the slide member 34, and this structure is preferred; however, the locking tab portion 64 may be formed on any member of the actuator assembly 24 or even on the base member 38 or the container assembly 22. In any configuration, the locking tab portion 64 is arranged to prevent movement of the actuator assembly 24 from its first position to its second position and then detached to allow such movement.

The finger portion 60 of the slide member 34 is sized and dimensioned to engage the nozzle member 32 as the slide member 34 moves along the outlet axis A. In particular, when the slide member 34 is in a first end position relative to the nozzle member 32, the outlet portion 50 of the nozzle member 32 is not deformed; the effective area of the outlet opening 52 is thus determined by the diameter of the nozzle member 32 when not deformed. As the slide member 34 moves from the first end position to a second end position, the finger portion 60 engages and deforms the nozzle member 32 such that the effective area of the outlet opening 52 reduces. And as the slide member 36 moves back to the first end position from the second end position, the resilient nozzle member 32 returns to its original, non-deformed configuration.

Accordingly, when rotated about the outlet axis, the collar member 36 causes the effective area of the outlet opening 52 to vary continuously from a first value corresponding to the first end position of the slide member 36 down to a second value corresponding to the second end position of the slide member 36.

The ability to vary the effective cross-sectional area of the outlet opening 52 is important with certain materials. For example, texture material may be dispensed in different texture patterns to match an existing texture pattern.

The structure employed to vary the cross-sectional area of the outlet opening may be different from that disclosed above. In addition, the present invention in its broadest form does not require the use of an actuator assembly having a variable outlet opening. The actuator assembly 24 depicted herein, while desirable for dispensing texture material, is not the only actuator assembly that may be used to implement the principles of the present invention.

The actuator assembly 24 is assembled as follows. The base member 38 is first attached to the container assembly 22. The stem portion 42 of the actuator member 30 is then inserted through the through opening 84 in the base member 38 until it engages the valve assembly within the container assembly 22. The collar member 36 is then arranged behind the actuator member 30 with the rail portion 70 thereof engaging the groove 82 in the base portion 38. The slide member 34 is then displaced along the outlet axis A towards the collar member 36 until the male threaded portion 62 of the slide member 34 engages the female threaded portion 72 of the collar member 36. The collar member 36 is then rotated relative to the slide member 34 such that the slide member 34 is drawn towards the collar member 36. The slide member 34 eventual reaches a locked location at which a notch 90 in the locking tab portion 64 engages a projection 92 on the base member 38.

Accordingly, with the actuator assembly 24 in its locked stated, the projection 92 engages the notch 90 to prevent further movement of the slide member 34 towards the collar member 36. The projection 92 also engages the notch 90 to prevent the slide member 34 from rotating up relative to the base member 38.

The aerosol system 20 will normally be shipped and stored with the actuator assembly 24 in its locked state. The locking tab portion 64 will help prevent accidental discharge of the liquid product. The locking tab portion 64 ensures that tampering without leaving evidence of such tampering takes significant effort (i.e., disassembly of the actuator assembly). Further, if the locking tab portion 64 is removed, this is evidence of tampering that allows manufacturers, distributors, and retailers to determine when and where the tampering is occurring.

2. Second Embodiment

Figure 4:
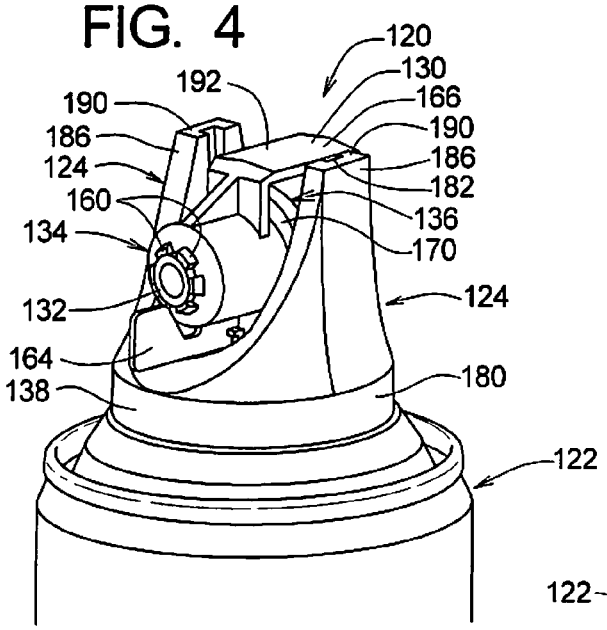
FIG. 4 is a perspective view of a second embodiment of an aerosol assembly of the present invention.
Figure 5:
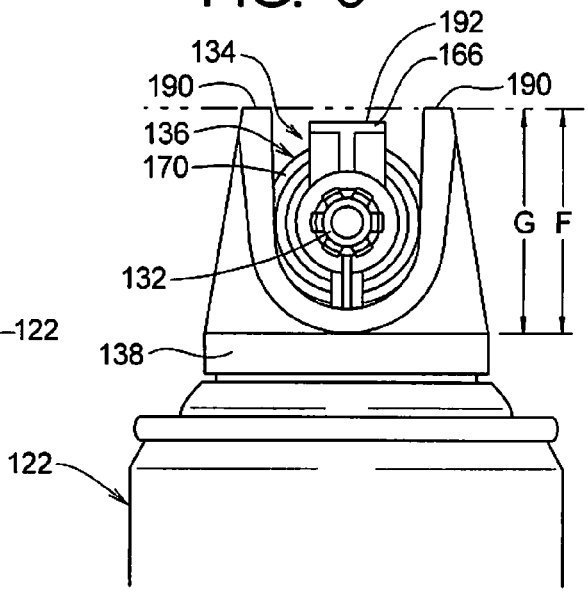
FIG. 5 is a front elevation view of the aerosol assembly of FIG. 4.

Referring now to FIGS. 4 and 5, depicted at 120 therein is an aerosol system constructed in accordance with a second embodiment of the present invention. The aerosol system 120 is similar to the aerosol system 20 described above and will be described herein only to the extent that these systems 20 and 120 differ.

The aerosol system 120 comprises a container assembly 122, an actuator assembly 124, and a valve assembly (not shown). The actuator assembly 124 comprises an actuator member 130, a nozzle member 132, a slide member 134, and a collar member 136. A base member 138 is mounted on the container assembly 122.

The actuator member 130 comprises a nozzle portion (not shown) and a stem portion (not shown) and defines at least a portion of a discharge passageway. The slide member 134 comprises a finger portion 160, a male threaded portion (not shown), a locking tab portion 164, and a button portion 166. The collar member 136 defines a rail portion 170 and a female threaded portion (not shown). The base member 138 comprises a mounting portion 180 and defines groove portions 182, a through opening (not shown), and a pair of ear members 186.

As with the aerosol system 20 described above, under certain conditions depressing the button portion 166 places the valve assembly in an open configuration to allow liquid product to be dispensed from the container 122 through the discharge passageway.

The aerosol system 120 differs from the system 20 in that the ear members 186 extend from the mounting portion 180 a distance F that is significantly larger than the distance that the ear members 86 extend from the mounting portion 80. As perhaps best shown in FIG. 5, this distance F is such that tips 190 of the ear members 186 are extend beyond and on either side of the button portion 166. In particular, when the actuator assembly 124 is mounted on the container assembly 122, an upper surface 192 of the button portion 166 is spaced a distance G from the mounting portion 180. The distance G is slightly less than distance F associated with the ear members 186.

A load applied on the top of the aerosol system 20 will thus engage the ear members 186 before engaging the button upper surface 192. The ear members 186 can be made in a geometric configuration that can bear loads that are significantly greater than the loads that can be carried by, for example, a conventional cap (not shown) commonly used to cover and protect the actuator assembly of an aerosol system. The ear members 186 can also be made to bear loads larger than those that can be borne by the tab portion 164 of the slide member 132. The ear members 186 thus significantly increase the ability of the aerosol system 20 to bear top loads such as those that would be created by stacking heavy items on a container carrying a plurality of systems 120.

3. Third Embodiment

Figure 6:
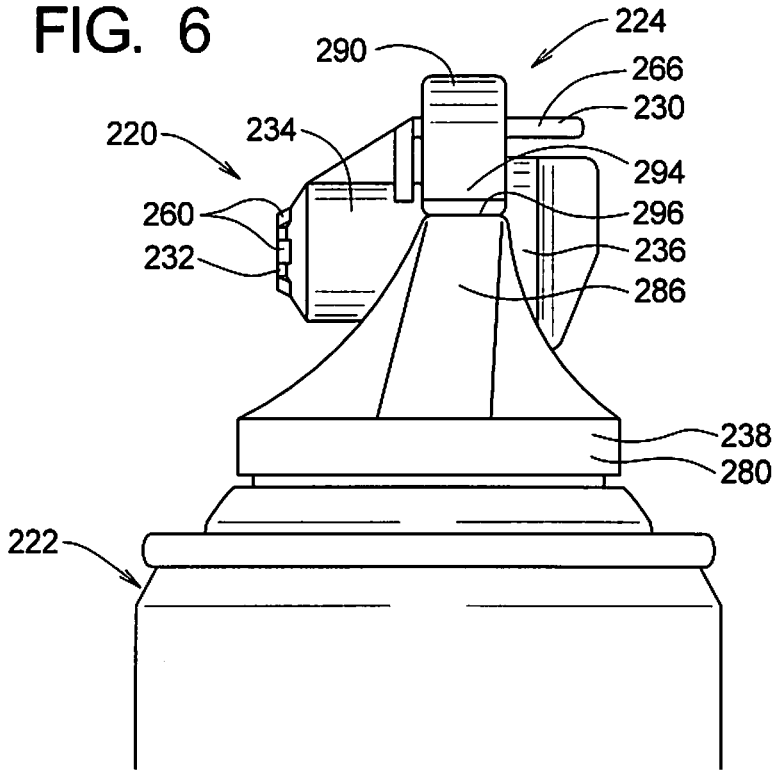
FIG. 6 is a side elevation view of a third embodiment of an aerosol assembly of the present invention.
Figure 7:
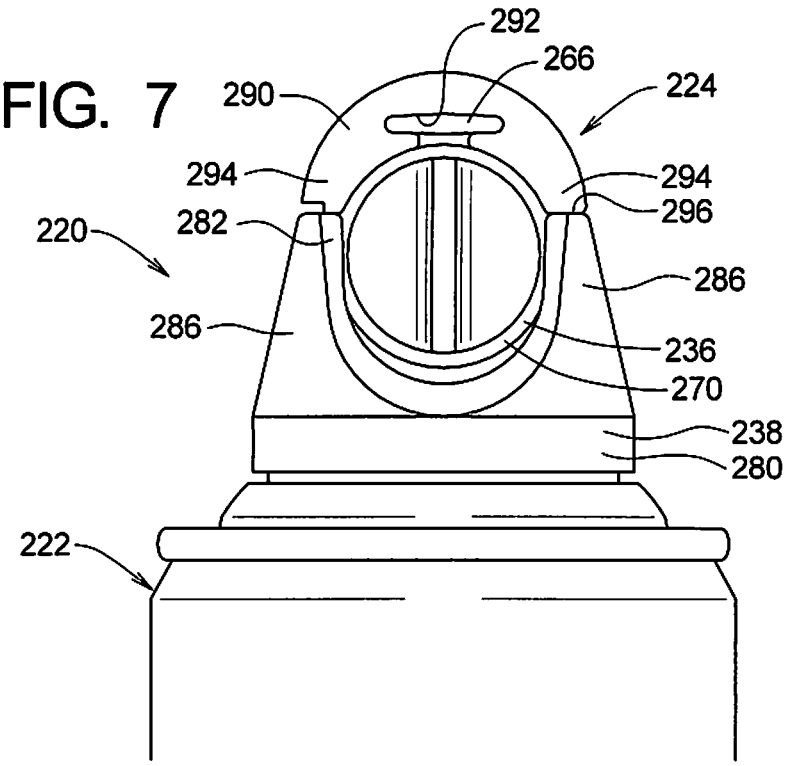
FIG. 7 is a front elevation view of the aerosol assembly of FIG. 6.

Referring now to FIGS. 6 and 7, depicted at 220 therein is an aerosol system constructed in accordance with a third embodiment of the present invention. The aerosol system 220 is similar to the aerosol systems 20 and 120 described above and will be described herein only to the extent that it differs from the systems 20 and 120.

The aerosol system 220 comprises a container assembly 222, an actuator assembly 224, and a valve assembly (not shown). The actuator assembly 224 comprises an actuator member 230, a nozzle member 232, a slide member 234, and a collar member 236. A base member 238 is mounted on the container assembly 222.

The actuator member 230 comprises a nozzle portion (not shown) and a stem portion (not shown) and defines at least a portion of a discharge passageway. The slide member 234 comprises a finger portion 260, a male threaded portion (not shown) and a button portion 266. The collar member 236 defines a rail portion 270 and a female threaded portion (not shown). The base member 238 comprises a mounting portion 280 and defines groove portions 282, a through opening (not shown), and ear portions 286.

As with the aerosol systems 20 and 120 described above, under certain conditions depressing the button portion 266 places the valve assembly in an open configuration to allow liquid product to be dispensed from the container 222 through the discharge passageway.

The aerosol system 120 differs from the systems 20 and 120 in that the actuator assembly 224 further comprises a tab member 290. The actuator assembly 224 is placed in its locked configuration by arranging the tab member 290 to engage the button portion 266 and the ear members 286. When the actuator assembly 24 is in its locked configuration, the button portion 266 cannot move relative to the ear members 286 under normal conditions. The tab member 290 thus functions as a tab portion that prevents movement of the actuator assembly 24 from its first position to its second position when attached to the button portion 266.

More specifically, the tab member 290 defines a locking channel 292 and a pair of elbow portions 294. The button portion 266 is sized and dimensioned to be received within the locking channel 292. The tab member 290 is moved into a locked position by displacing the member 290 such that the locking channel 292 receives at least a portion of the button portion 266. The tab member 290 can move only in a removal direction from the locked position, with friction maintaining the tab member on the button portion 266. When the tab member 290 is in the locked position, the elbow portions 294 engage upper surfaces 296 formed on the ear members 286. The elbow portions 294 bridge over the top of the button portion 266 and suspend the button portion 266 below the locking channel 292.

The tab member 290 thus protects the button portion 266 from top loads by forming a structural member that extends over the top of the button portion 266 and also prevents inadvertent depressing of the button portion 266. A tamper seal may be adhered to the tab member 290 and the button portion 266 such that the tamper seal must be destroyed before the tab member 290 is detached from the button portion 266. Such a tamper seal will allow detection of tampering.

The exemplary tab member 290 engages the button portion 266 using a rail and channel, other attachment systems may be used. For example, a peg that frictionally engages a peg, a snap fit, a temporary adhesive or the like may be used as attachment systems. Generally speaking, any such attachment system should require the tab member 290 to be displaced relative to the button portion in a direction perpendicular to the direction in which the button portion 266 is pressed. This avoids moving the actuator assembly 24 from its first to its second position while attaching the tab member 290 to the button portion 266.

4. Fourth Embodiment

Figure 8:
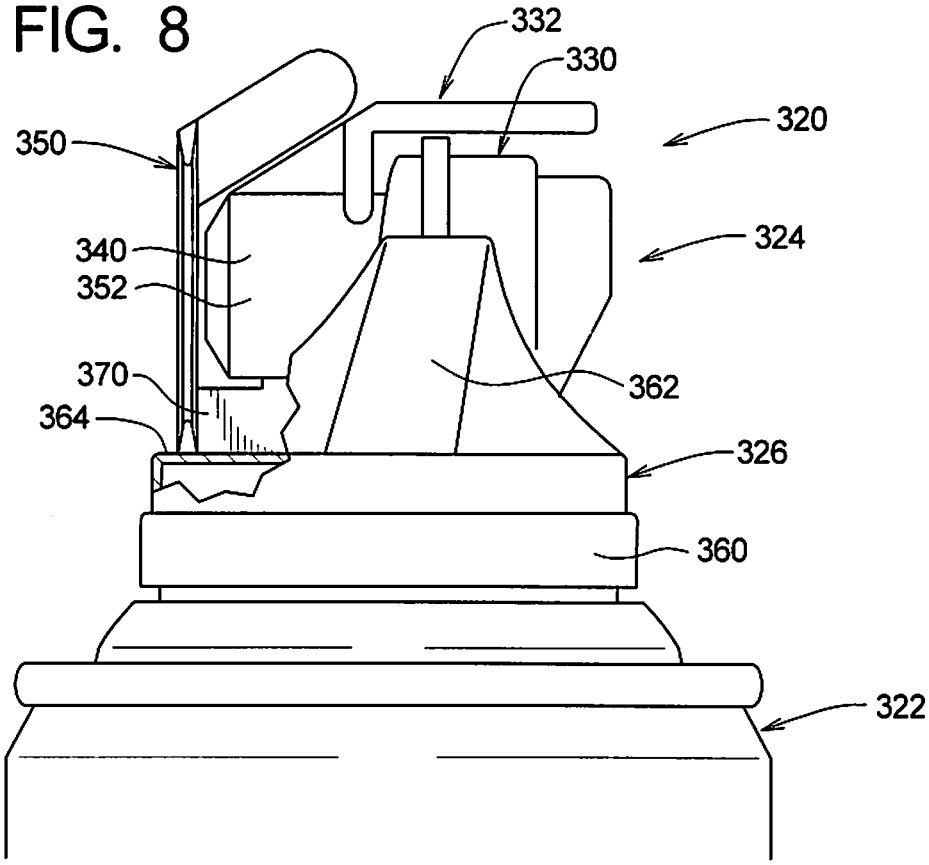
FIG. 8 is a side elevation view of a fourth embodiment of an aerosol assembly of the present invention.
Figure 9:
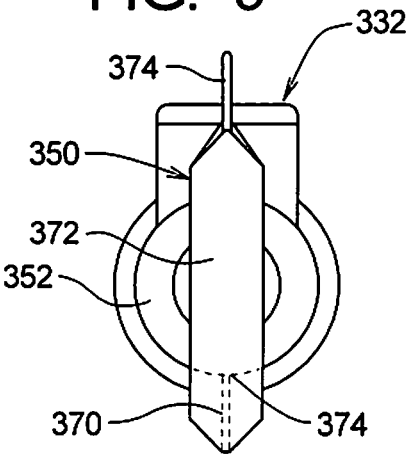
FIG. 9 is a front elevation view of a nozzle member of the aerosol assembly of FIG. 8.
Figure 10:
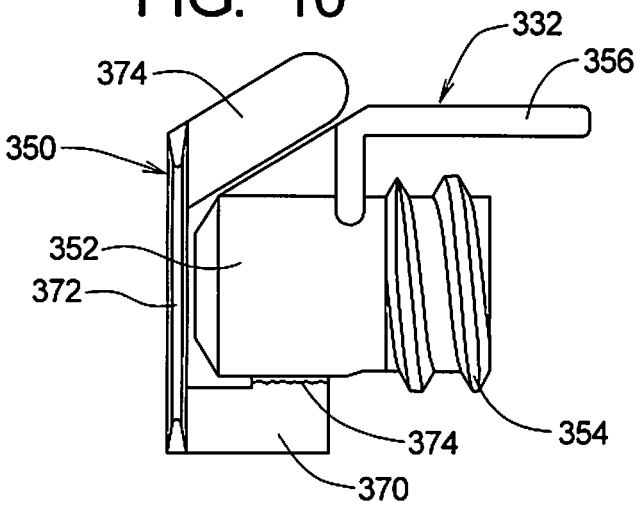
FIG. 10 is a side elevation view of the nozzle member of FIG. 9.

Referring now to FIGS. 8-10, depicted at 320 therein is an aerosol system constructed in accordance with a third embodiment of the present invention. The aerosol system 320 will be described herein primarily to the extent that it differs from the systems 20, 120, and 220 described above.

The aerosol system 320 comprises a container assembly 322, an actuator assembly 324, and a valve assembly (not shown) mounted on the container assembly 322. The container assembly 322 and valve assembly are or may be conventional and will not be described herein in detail. As shown in FIG. 8, an optional base member 326 may be mounted on the container assembly 322.

The actuator assembly 324 comprises an actuator member 330 and a nozzle member 332. The actuator member 330 defines at least a portion of a discharge passageway and comprises a nozzle portion 340 and a stem portion (not shown in FIG. 8). A portion of the nozzle portion 340 is configured to define an internal threaded portion (not shown in FIG. 8). The nozzle member 332 comprises a locking tab portion 350, nozzle portion 352, a male threaded portion 354, and a button portion 356 and at least a portion of the discharge passageway. The base member 326 comprises a mounting portion 360 and a pair of ear portions 362 (only one shown in FIG. 8) and defines a stop surface 364.

The discharge passageway defined by the actuator member 330 and nozzle member 332 may define a fixed outlet opening, or the outlet opening defined thereby may be adjustable as with the systems 20, 120, and 220 described above. If the discharge passageway is fixed, the functions of the actuator member 330 and nozzle member 332 may be implemented in a single part.

Initial fabrication of the aerosol system 320 is accomplished by engaging the male threaded portion 354 of the nozzle member 332 with the internal threaded portion of the actuator member 330 to form the actuator assembly 324. The stem portion of the actuator member 330 is then engaged with the valve assembly to form the aerosol system 320.

When the actuator assembly 324 is initially placed on the container assembly 322, the system 320 is in a locked configuration. In particular, the locking tab portion 350 comprises a lock portion 370, a connecting portion 372, and a handle portion 374. The lock portion 370 is connected to or integrally formed with the nozzle portion 340 of the actuator member 330 at a break line 376. The connecting portion 372 connects the lock portion 370 to the handle portion 374.

When the system 320 is in the locked configuration, the lock portion 370 is arranged between the nozzle portion 352 of the actuator member 330 and the container assembly 322. When an actuating force is applied to the button portion 356, the lock portion 370 prevents the actuator member 330 from moving towards the container assembly 322. The lock member 370 thus prevents movement of the actuator member 330 relative to the container assembly 322 that would place the valve assembly in its open configuration and cause product within the container assembly 322 to be dispensed.

To remove the system 320 from the locked configuration, the handle portion 374 is rotated or twisted to cause the locking tab portion 350 separate from the nozzle portion 340 at the break line 376. With the lock portion 370 no longer arranged between the container assembly 322 and the nozzle portion 352 of the actuator member 330, the aerosol assembly 320 is in an unlocked configuration. When the aerosol assembly is in the unlocked configuration, the actuator member 330 is free to travel toward the container assembly 322. Depressing the button portion 356 of the nozzle member 332 when the system 320 is in the unlocked position thus causes the valve assembly to open, thereby allowing material within the container assembly 322 to be dispensed along the discharge passageway.

If used, the base member 326 is secured to the container assembly 322 such that the lock member 370 engages the stop surface 364 of the base member 326 when the system 320 is in the locked configuration. In this case, the lock member 370 indirectly engages the container assembly 322 through the base member 326.

The ear portions 362 of the base member 326 extend at least partly along opposing sides of the actuator assembly 324. The ear portions 362 thus protect the actuator assembly 324 from at least side impacts.

5. Fifth Embodiment

Referring now to FIGS. 11-27, depicted at 420 therein is an dispensing assembly that may be used by a fifth embodiment of an aerosol system of the present invention. The dispensing assembly 420 will be described herein primarily to the extent that it differs from the actuator assemblies 24, 124, 224, and 324 described above.

The aerosol system incorporating the example actuator system 420 comprises a container assembly and a valve assembly mounted on the container assembly as generally described above. The container assembly and valve assembly are or may be conventional and will not be described herein in detail.

The dispensing assembly 420 comprises a base member 430, an actuator member 432, an outlet member 434, a collar member 436, and a selector member 438. The base member 430 is adapted to engage the container assembly of the aerosol system. The actuator member 432 extends through the base member 430 to engage the valve assembly of the aerosol system. The actuator member 432 further supports the resilient outlet member 434.

With the actuator member 432 supporting the outlet member 434, the actuator member 432 and outlet member 434 define an outlet passageway through which material is dispensed from the container assembly and through the valve assembly. The outlet passageway terminates in an outlet opening defined by the outlet member 434. The collar member 436 extends around a portion of the actuator member 432. The selector member 438 engages the base member 430 and the collar member 436 such that rotation of the selector member 438 relative to the collar member 436 displaces the collar member 436 relative to the actuator member 432. As the collar member 436 is displaced relative to the actuator member 432, the collar member 436 acts on the actuator member 432 such that the outlet member 434 is deformed. Deforming the outlet member 434 alters the cross-sectional area of the outlet opening defined by the outlet member 434.

Referring for a moment now to FIGS. 12, 13, and 18A-18D, depicted therein in further detail is the example collar member 436. The collar member 436 comprises an engaging portion 440, a security tab portion 442, and a button portion 444. A collar threaded portion 446 is formed on the engaging portion 440, and a lock projection 448 is formed on the button portion 444. The collar member 436 further defines a collar chamber 450. A first collar opening surface 452, second collar opening surface 454, and collar slot 456 allow access to the collar chamber 450.

Figure 12:
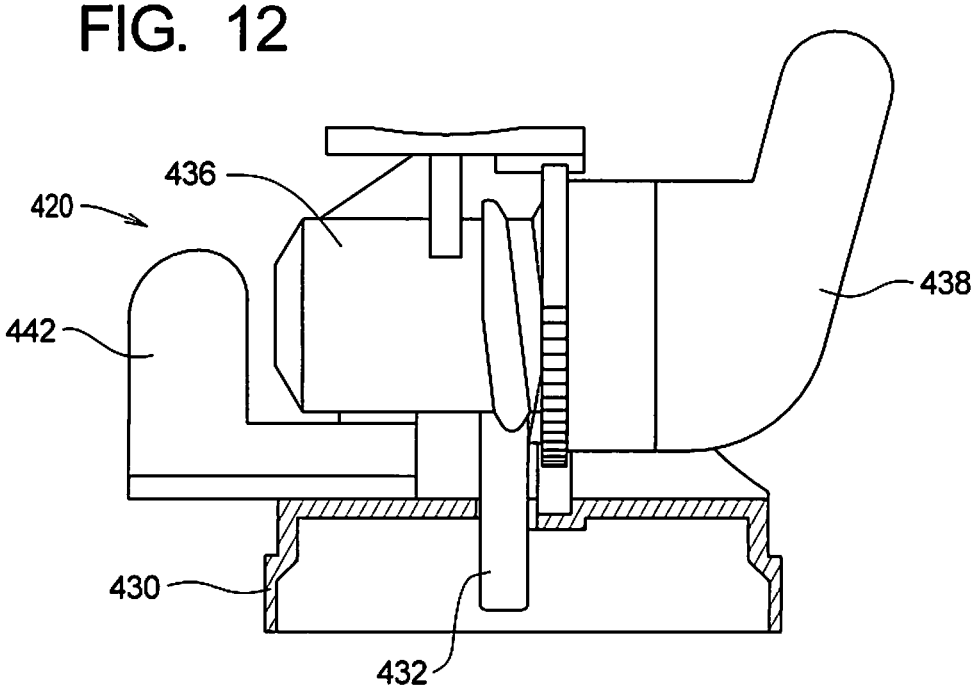
FIGS. 12 and 13 are side elevation, partial cutaway views of the dispensing assembly of FIG. 11 illustrating the removal of a security tab portion.
Figure 13:
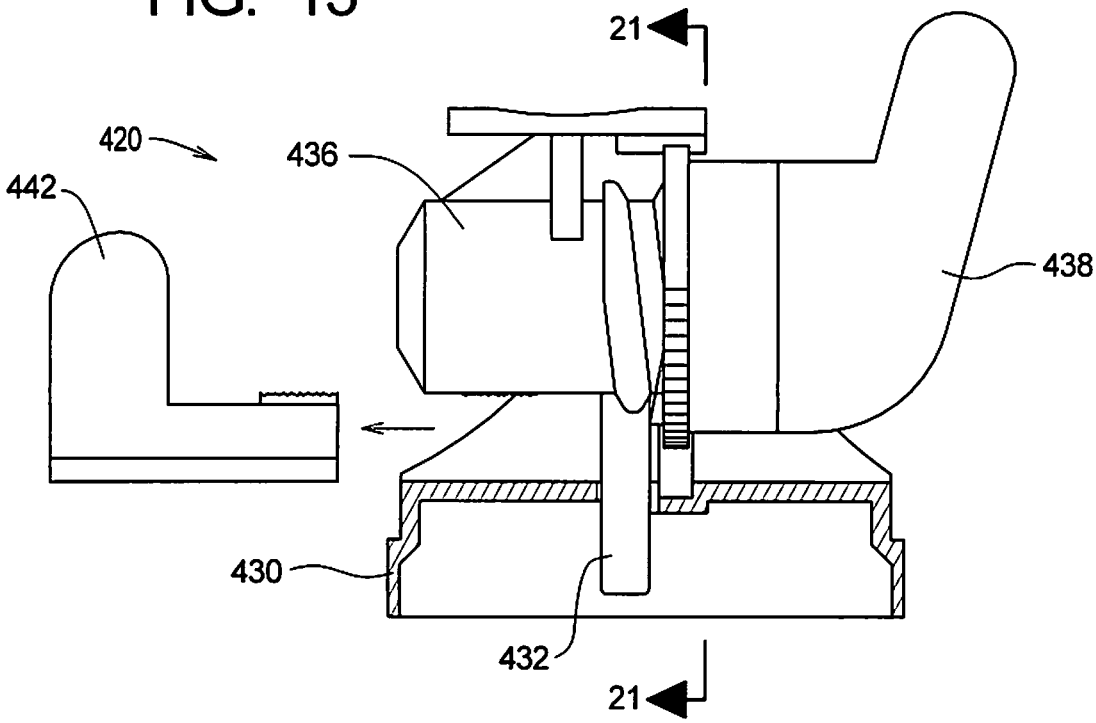
Figure 18A:
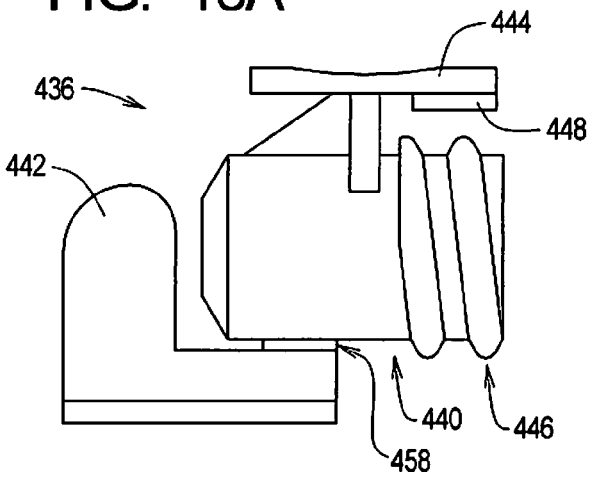
FIGS. 18A-C are side elevation, front elevation, and bottom plan views of the collar member (including security tab portion) of the dispensing assembly of FIGS. 11 and 12.
Figure 18B:
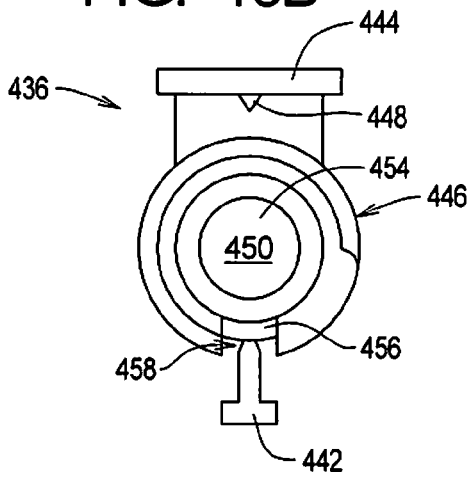
Figure 18C:
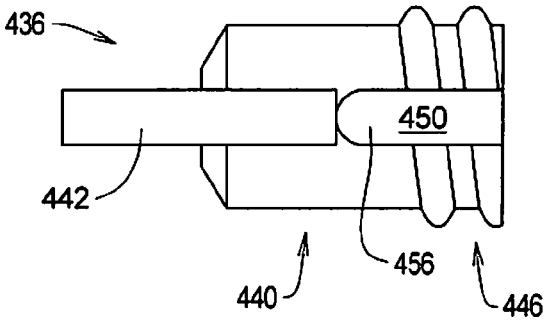
Figure 18D:
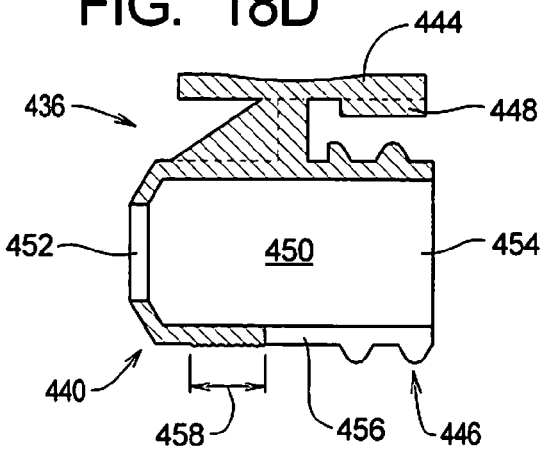
FIG. 18D is a side elevation cutaway view of the collar member of FIGS. 18A-C with the security tab portion removed.
Figure 19A:
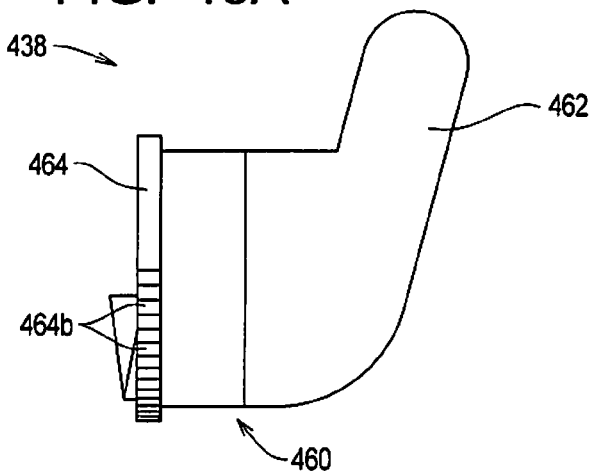
FIGS. 19A-19E are side elevation, rear elevation, bottom plan, front elevation, and side elevation cutaway views of the selector member of the dispensing assembly of FIGS. 11 and 12.
Figure 19B:
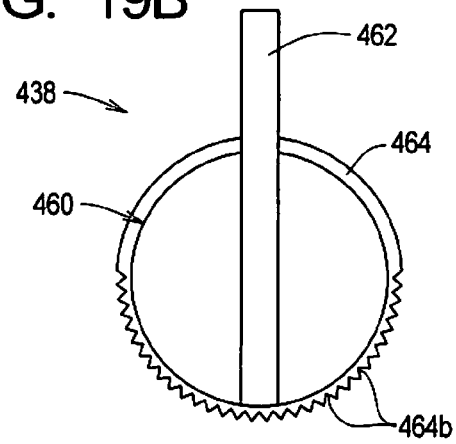
Figure 19C:
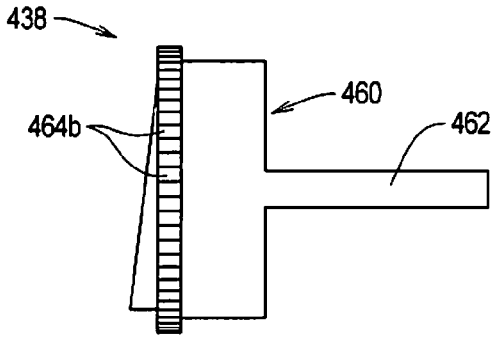
Figure 19D:
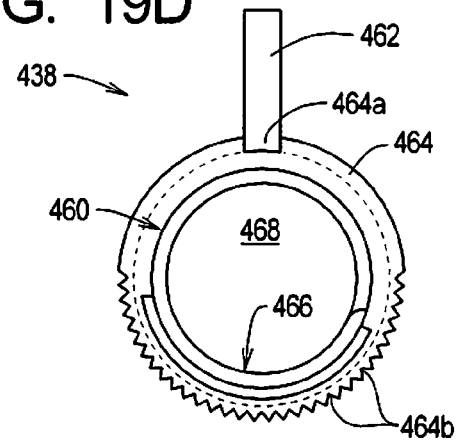
Figure 19E:
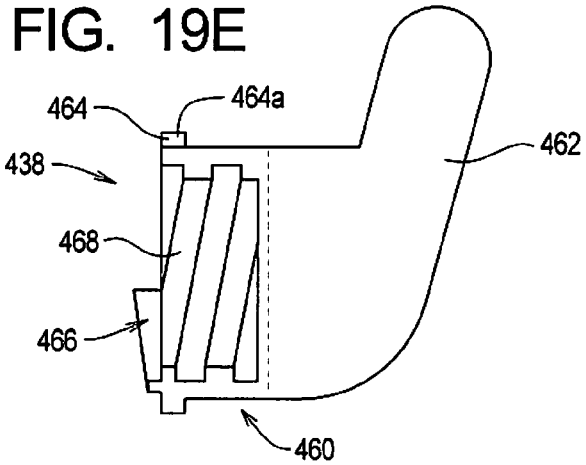

As shown by a comparison of FIGS. 12 and 13, the security tab portion 442 may be removed from the engaging portion 440 by deliberate application of manual force on the security tab portion 442. FIGS. 18B and 18D illustrate a reduced cross-section portion 458 that facilitates removal of the security tab portion 442 from the engaging portion 440. As will be described in further detail below, the dispensing assembly 420 cannot be operated until the security tab portion 442 is removed.

Turning now to FIGS. 19A-E, the example selector member 438 is depicted in further detail therein. The selector member 438 comprises a receiving portion 460, a handle portion 462, a flange portion 464, and selector threaded portion 466. The selector threaded portion 466 defines internal threads around a receiving recess 468. A storage notch 464*a* and ratchet notches 464*b* are formed in the flange portion 464.

The internal selector threaded portion 466 is sized and dimensioned to receive the collar threaded portion 446. When the collar threaded portion 446 is received by the selector threaded portion 466, rotation of the selector member 438 relative to the collar member 436 displaces the collar member 436 relative to the selector member 438 as will be described in further detail below.

In addition, when the threaded portions 466 and 446 engage each other, the lock projection 448 of the collar member 436 is located to engage the flange portion 464 of the selector member 438. Depending upon an angular relationship between the collar member 436 and selector member 438, the lock projection 448 may extend into the storage notch 464*a* or one of the ratchet notches 464*b* in the flange portion 464.

The engagement of the lock projection 448 with the notch 464*a* or one of the notches 464*b* in the flange portion 464 can fix an angular relationship between the collar member 436 and the selector member 438 against inadvertent movement. However, the deliberate application of manual force can rotate the selector member 438 relative to the collar member 436 when a change in the angular relationship therebetween is desired.

Turning now to FIGS. 17A-17D, the construction of the example base member 430 will now be described in further detail. The example base member 430 comprises a container engaging portion 470, first and second supports 472 and 474, an alignment groove 476, and a bottom opening 478. The container engaging portion 470 is sized and dimensioned to engage the container of the aerosol system, similar to the situation depicted in FIG. 2A of the drawing.

The first and second supports 472 and 474 extend from the container engaging portion 470. The alignment groove 476 extends along the inner surfaces of the supports 472 and 474. The bottom opening 478 allows access through the base member 430 as will be described in detail below.

Figure 20A:
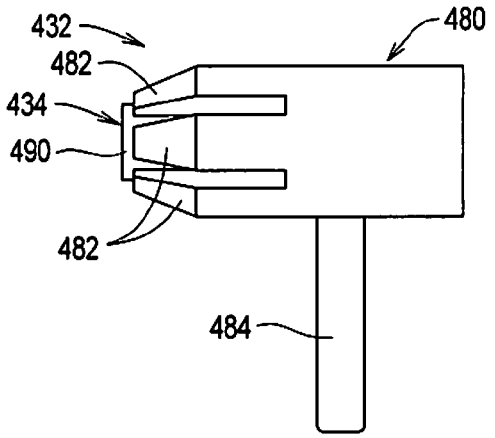
FIG. 20A is a side elevation view of the actuator member and outlet member of the dispensing assembly of FIGS. 11 and 12.
Figure 20B:
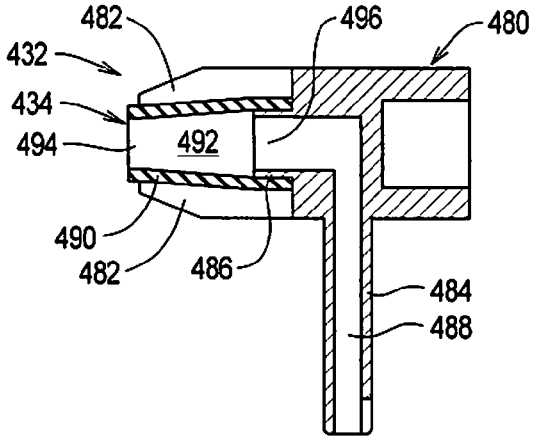
FIG. 20B is a side elevation cutaway view of the actuator member and outlet member depicted in FIG. 20A.

Turning now to FIGS. 20A and 20B of the drawing, the construction of the example actuator member 432 and example outlet member 434 will be described in further detail. The example actuator member 432 comprises a mounting portion 480, a plurality of finger portions 482, a valve stem 484, and an outlet seat 486. The term "plurality" is used in this application to denote two or more of an item. An actuator passageway 488 extends through the valve stem 484, the mounting portion 480, and the outlet seat 486.

The example outlet member 434 is a cylindrical tube 490 made of resilient material that defines an outlet passageway 492. One end of the outlet member 434 defines an outlet opening 494. The other end of the outlet member 434 defines a seat opening 496 that is sized and dimensioned to receive the outlet seat 486.

To combine the members 430, 432, 434, 436, and 438 to obtain the dispensing assembly 420, the outlet member 434 is first placed within the finger portions 482 of the actuator member 432 such that the seat opening 496 snugly fits over the outlet seat 486 as shown in FIG. 20B. The engagement of the outlet member 434 with the outlet seat 486 prevents inadvertent removal of the outlet member 434 from within the finger portions 482.

Figure 16:
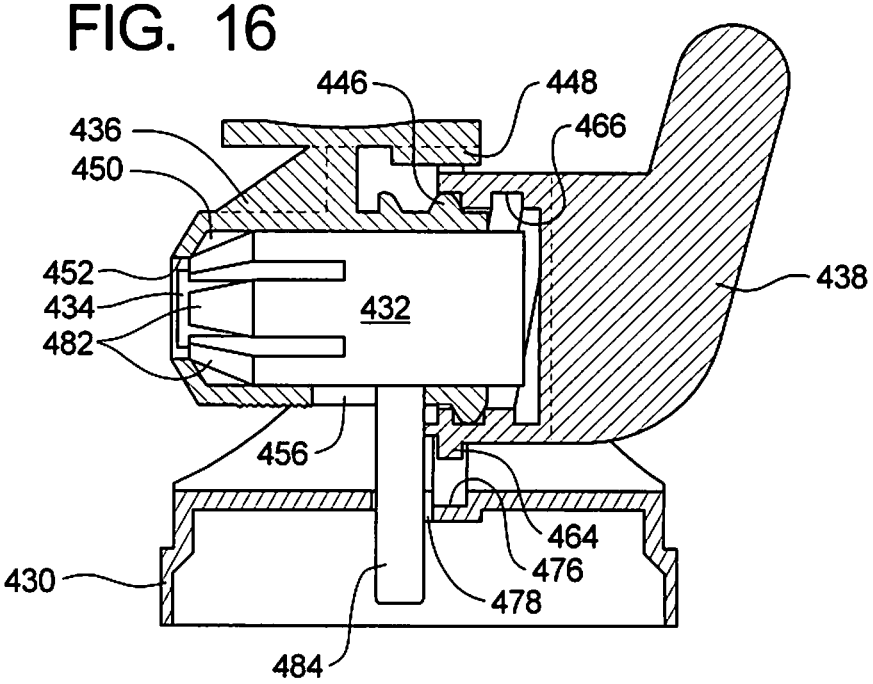
FIG. 16 is a side elevation, partial cutaway view of the dispensing assembly of FIGS. 11 and 12 illustrating the interaction of the base member, collar member, selector member, and actuator member thereof.
Figure 17A:
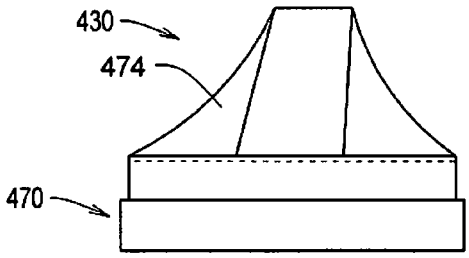
FIGS. 17A-17D are side elevation, front elevation, top plan, and side elevation cutaway views of a base member of the dispensing assembly of FIGS. 11 and 12.
Figure 17B:
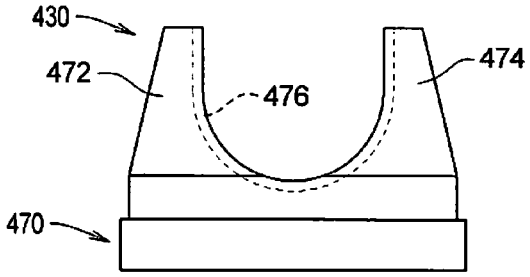
Figure 17C:
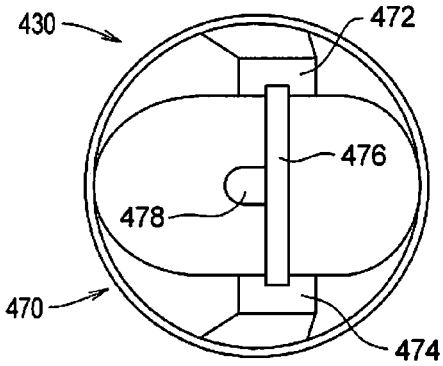
Figure 17D:
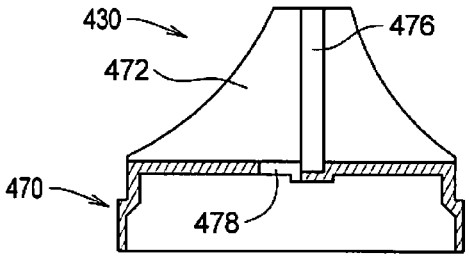

The actuator member 432, with the outlet member 434 supported thereby, is then placed within the collar chamber 450 defined by the collar member 436 as perhaps best shown in FIG. 16. The valve stem portion 484 of the actuator member 432 passes through the collar slot 456 in the collar member 436.

Figure 14:
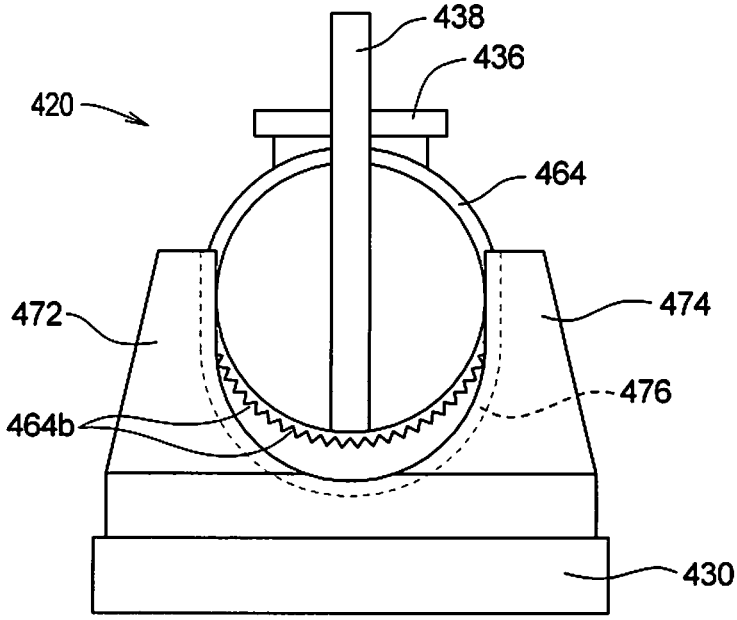
FIG. 14 is a rear elevation view of the dispensing assembly of FIGS. 11 and 12.
Figure 15:
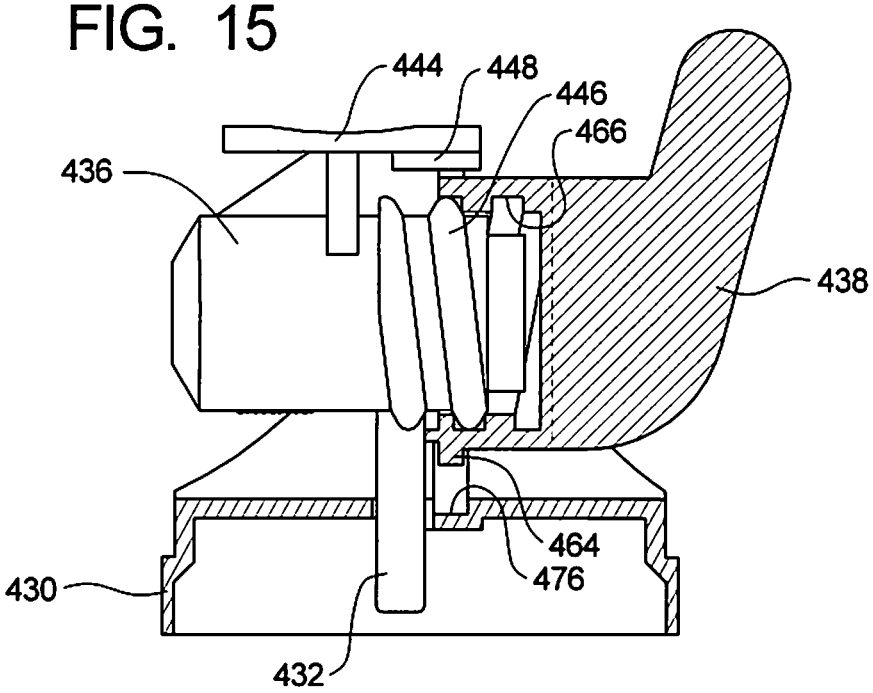
FIG. 15 is a side elevation, partial cutaway view of the dispensing assembly of FIGS. 11 and 12 illustrating the interaction of a base member with a selector member thereof.

Again as shown in FIGS. 15 and 16, the selector member 438 is arranged such that the selector threaded portion 466 engages the collar threaded portion 446 of the collar member 436. The selector member 438 is then rotated until the lock projection 448 on the collar member 436 enters the storage notch 464*a* in the flange 464 on the selector member 438. At this point, the angular orientation of the selector member 438 relative to the collar member is as shown, as examples, in FIGS. 11-16 and 21.

The actuator member 432, outlet member 434, collar member 436, and selector member 438 are then displaced such that the valve stem 484 extends through the bottom opening 478 in the base member 430 (FIG. 16). At this point, the flange 464 on the selector member 438 is received by the alignment groove 476. In addition, the valve stem 484 engages the valve assembly in a conventional manner.

Figure 11:
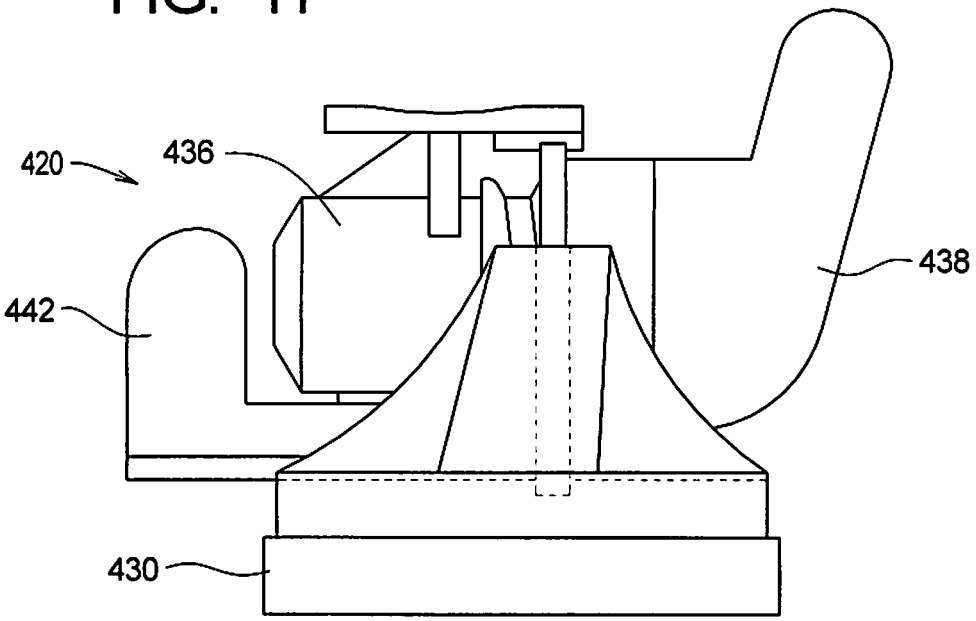
FIG. 11 is a side elevation view of a dispensing assembly that may be used as part of a fifth embodiment of an aerosol assembly of the present invention.

Initially, with the security tab 442 in place as shown, as examples, in FIGS. 11 and 12, the button portion 444 of the collar member 436 cannot be depressed to open the valve assembly. However, with the security tab 442 removed as shown in FIGS. 13, 15, 16, 23, and 26, applying a force on the button portion 444 displaces the collar member 436, and actuator member 432 supported thereby, towards the container. So displaced, the valve stem 484 places the valve assembly in an open configuration to dispense material.

Figure 21:
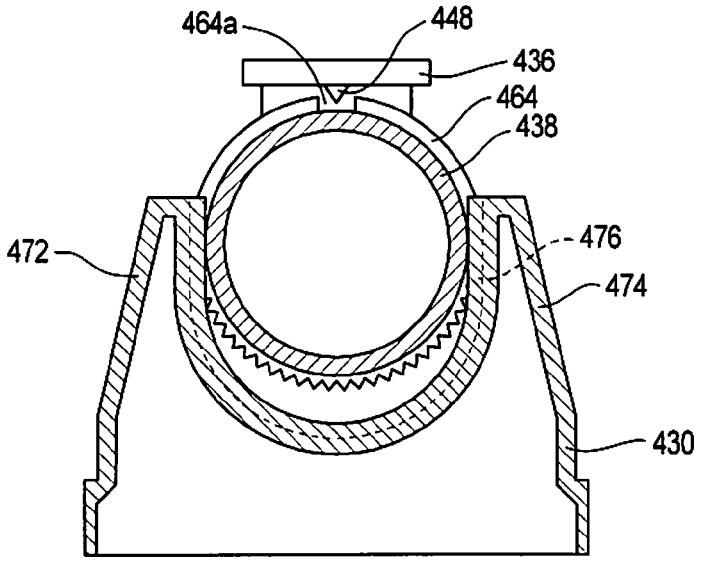
FIG. 21 is a front elevation view section view depicting the interaction of the base member with the selector member of the dispensing assembly of FIGS. 11 and 12 in a storage configuration.

As shown in FIGS. 14 and 21, the shape of the supports 472 and 474 is such that the alignment groove 476 maintains the selector member 438 in a desired orientation relative to the base member 430. However, the alignment groove 476 is shaped to allow the actuator member 432 to be displaced towards the base member 430 as previously described.

Figure 22:
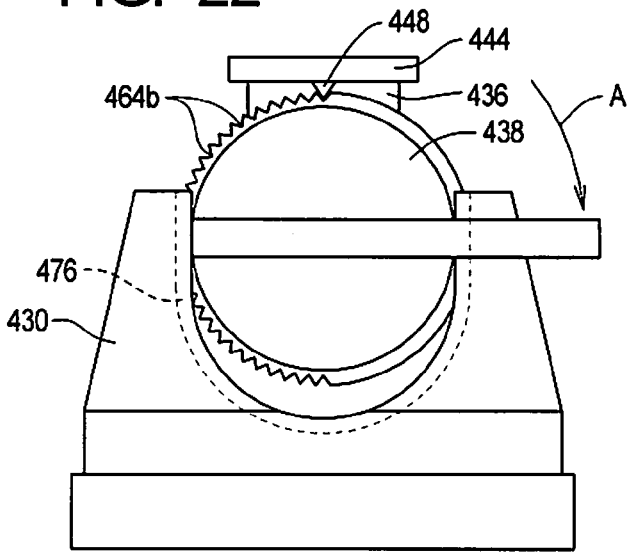
FIGS. 22, 23, and 24 depict the orientation of the selector member and the collar member with respect to the base member of the dispensing assembly of FIGS. 11 and 12 in a first use configuration.
Figure 23:
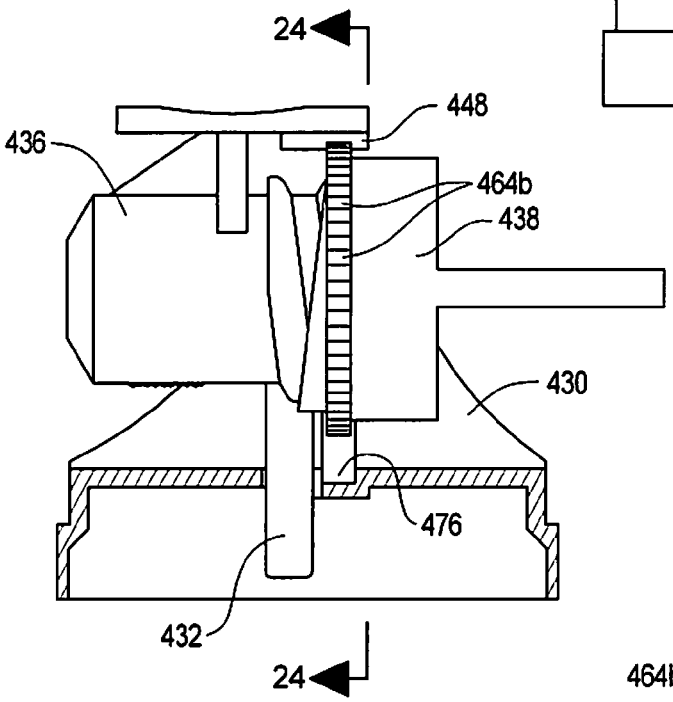
Figure 24:
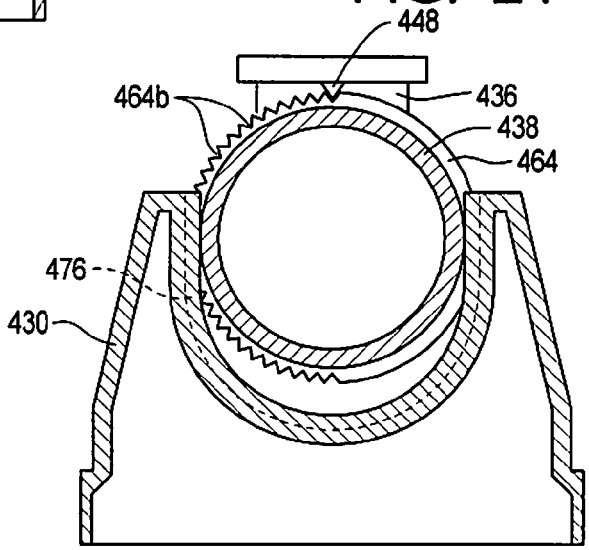

To change a cross-sectional area of the outlet opening 494, selector member 438 is rotated as shown by arrow A in FIG. 22 to change an angular orientation of the selector member 438 relative to the collar member 436. When the angular orientation is as shown in FIGS. 22-24, the lock projection 448 engages a first end of the ratchet portion 464*b*. The ratchet notches engage the lock projection 448 to maintain the angular orientation as desired. At this point, the outlet opening 494 is at its biggest cross-sectional area (outlet member 434 not deformed).

Figure 25:
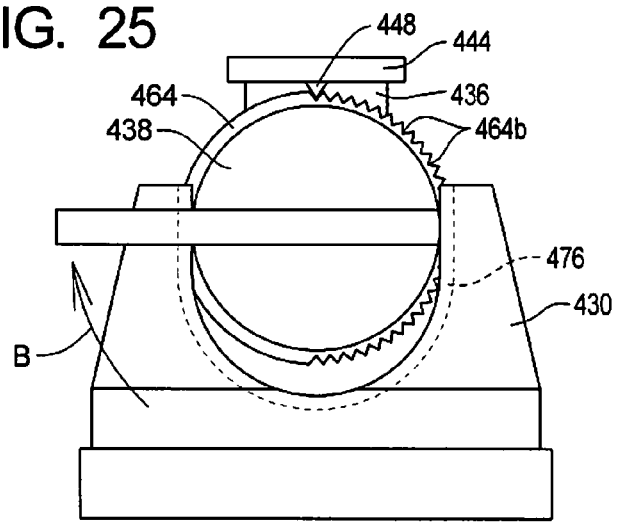
FIGS. 25, 26, and 27 depict the orientation of the selector member and the collar member with respect to the base member of the dispensing assembly of FIGS. 11 and 12 in a second use configuration.
Figure 26:
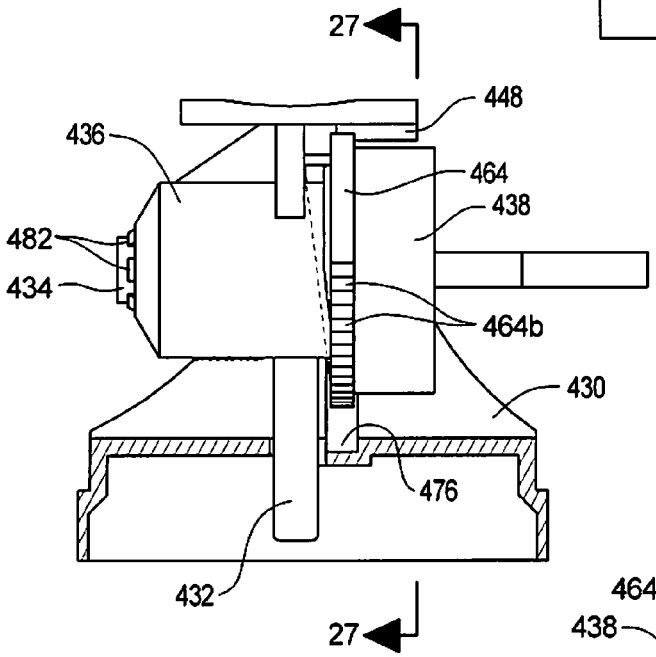
Figure 27:
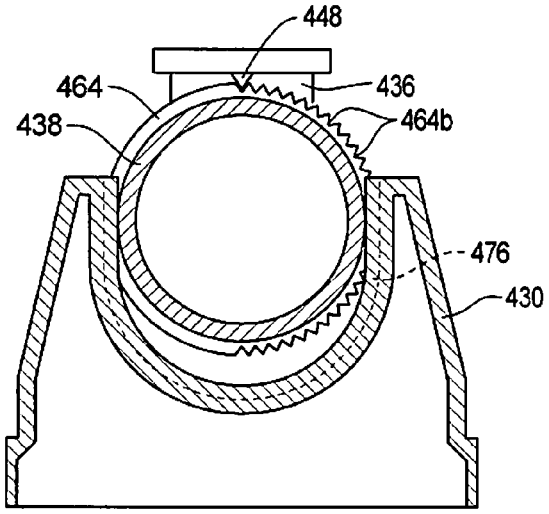

As shown in FIG. 25, continued rotation of the selector member 438 in the direction of arrow B further changes the angular orientation of the selector member 438 relative to the collar member 436. As this angular orientation changes, the threaded portions 446 and 466 engage each other to displace the collar member 436 into the receiving recess 468 of the selector member 438. Because the selector member 438 and actuator member 432 are fixed relative to the base member 430, the collar member 436 is displaced relative to the actuator member 432 as perhaps best shown by a comparison of FIGS. 23 and 26.

As perhaps best shown in FIG. 16, the first opening surface 452 on the collar member 436 engages the finger portions 482 on the actuator member 432. These finger portions 482 are flexible such that, when engaged by the opening surface 452, the finger portions 482 deflect towards each other.

Because the outlet member 434 is arranged within the finger portions 482, the finger portions 482 squeeze the outlet member 434 when the selector member 438 is rotated in the direction shown by arrows A and B in FIGS. 22 and 25. Squeezing the outlet member 434 causes the cross-sectional area of the outlet opening 494 to be reduced. Rotating the selector member 438 in a direction opposite to the direction shown by arrows A and B in FIGS. 22 and 25 increases the cross-sectional area of the outlet opening 494.

Further, when the angular orientation of the selector member 438 relative to the collar member 436 is between the positions shown in FIGS. 22 and 25, the ratchet notches engage the stop projection 448 to fix the angular orientation of the selector member 438 relative to the collar member 436 against inadvertent motion.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

What is claimed is:

1. An aerosol system for dispensing liquid material, comprising:

a container assembly; and an actuator assembly comprising an outlet member defining an outlet opening;

a collar member;

an actuator member, where the actuator member is supported by the container assembly in first and second positions, and supports the collar member and the outlet member such that movement of the collar member relative to the actuator member causes the collar member to deform the outlet member;

a selector member, where movement of the selector member relative to the collar member causes movement of the collar member relative to the actuator member; wherein deformation of the outlet member alters a cross-sectional area of the outlet opening;

when the actuator assembly is in the first position, the liquid material is prevented from flowing out of the container; and when the actuator assembly is in the second position, the liquid material is allowed to flow out of the container assembly through the outlet opening.

2. An aerosol system as recited in claim 1, in which the actuator member is adapted to engage the container assembly such that displacement of the actuator member causes fluid to flow through the outlet opening.

3. An aerosol system as recited in claim 1, in which the actuator assembly further comprises a base member, where the base member is adapted to engage the container assembly and the selector member.

4. An aerosol system as recited in claim 1, further comprising a base member, in which:

the base member defines an alignment structure;

the alignment structure engages the selector member to allow rotation of the selector member relative to the collar member.

5. An aerosol system as recited in claim 4, in which;

the alignment structure is defined by a groove formed in the base structure; and the selector member defines a rail; wherein the groove is sized and dimensioned to receive the rail as the selector member rotates relative to the collar member.

6. An aerosol system as recited in claim 1, in which:

the actuator member defines at least one finger portion that engages the outlet member; and movement of the collar member relative to the actuator member deforms the at least one finger portion to deform the outlet member.

7. An aerosol system as recited in claim 1, in which:

the actuator member defines a plurality of finger portions, where the plurality of finger portions support the outlet member; and movement of the collar member relative to the actuator member deforms the finger portions to deform the outlet member.

8. An aerosol system as recited in claim 1, in which:

the selector member defines a selector threaded portion;

the collar member defines a collar threaded portion; and the selector threaded portion engages the collar threaded portion such that rotation of the selector member displaces the collar member relative to the actuator member.

9. An aerosol system as recited in claim 1, in which:

the selector member comprises a flange portion defining a plurality of ratchet notches;

the collar member defines a lock projection; and the lock projection engages one of the plurality of ratchet notches to release-ably secure the selector member in a desired angular orientation relative to the collar member.

10. An aerosol system as recited in claim 1, in which:

the selector member comprises a flange portion defining a plurality of ratchet notches;

the collar member defines a lock projection;

the base portion defines an alignment structure;

the flange portion engages the alignment structure to allow the selector member to rotate relative to the collar member; and the lock projection engages one of the ratchet notches to release-ably secure the selector member in a desired angular position relative to the collar member.

11. A method of dispensing liquid material, comprising the steps of:

providing a container assembly;

providing an outlet member defining an outlet opening;

providing a collar member;

providing an actuator member;

providing a selector member;

supporting the collar member and the outlet member on the actuator member;

supporting the selector member relative to the collar member such that movement of the selector member relative to the collar member causes movement of the collar member relative to the actuator member;

supporting the actuator member relative to the container assembly;

moving the selector member relative to the collar member to move the collar member relative to the actuator member to cause the collar member to deform the outlet member and thereby alter a cross-sectional area of the outlet opening; and displacing the actuator member to allow the liquid material to flow out of the container assembly through the outlet opening.

12. A method as recited in claim 11, in which the step of supporting the actuator member relative to the container assembly comprises the step of engaging the actuator member with the container assembly such that the actuator is movable relative to the container assembly.

13. A method as recited in claim 11, further comprising the step of arranging a base member to engage the container assembly and the selector member.

14. A method as recited in claim 13, further comprising the steps of:

defining an alignment structure on the base member;

engaging the alignment structure with the selector member such that the selector member may rotate relative to the collar member.

15. A method as recited in claim 14, in which:

the step of providing the selector member comprises the step of forming a rail on the selector member; and the step of defining an alignment structure on the base member comprises the step of forming a groove in the base structure such that the groove is sized and dimensioned to receive the rail as the selector member rotates relative to the collar member.

16. A method as recited in claim 11, in which:

the step of providing the actuator member further comprises the step of forming at least one finger portion, where the at least one finger portion engages the outlet member; and the step of moving of the collar member relative to the actuator member comprises the step of deforming the at least one finger portion to deform the outlet member.

17. A method as recited in claim 11, in which:

the step of providing the actuator member comprises the step of forming a plurality of finger portions, where the plurality of finger portions support the outlet member; and the step of moving of the collar member relative to the actuator member comprises the step of deforming the finger portions to deform the outlet member.

18. A method as recited in claim 11, in which:

the step of providing the selector member comprises the step of forming a selector threaded portion;

the step of providing the collar member comprises the step of forming a collar threaded portion; and engaging the selector threaded portion with the collar threaded portion such that rotation of the selector member displaces the collar member relative to the actuator member.

19. A method as recited in claim 11, in which:

the step of providing the selector member comprises the step of forming a flange portion defining a plurality of ratchet notches;

the step of providing the collar member comprises the step of forming a lock projection; further comprising the step of engaging the lock projection with one of the plurality of ratchet notches to release-ably secure the selector member in a desired angular orientation relative to the collar member.

20. A method as recited in claim 11, in which:

the step of providing the selector member comprises the step of forming a flange portion defining a plurality of ratchet notches;

the step of providing the collar member comprises the step of forming a lock projection; further comprising the steps of providing base portion defining an alignment structure;

engaging the flange portion with the alignment structure to allow the selector member to rotate relative to the collar member; and engaging the lock projection with one of the ratchet notches to release-ably secure the selector member in a desired angular position relative to the collar member.

* * * * *